US010246804B2

(12) United States Patent
Whitehead et al.

(10) Patent No.: US 10,246,804 B2
(45) Date of Patent: Apr. 2, 2019

(54) BRAIDING MACHINE

(71) Applicants: FUSE LONDON LTD, London (GB); SPIN MASTER LTD., Toronto (CA)

(72) Inventors: Brian Whitehead, Romney Marsh (GB); Mollie B. Jameson, Toronto (CA); Herman Chan, Toronto (CA)

(73) Assignees: FUSE LONDON LTD, London (GB); SPIN MASTER LTD., Toronto (CA)

( * ) Notice: Subject to any disclaimer, the term of this patent is extended or adjusted under 35 U.S.C. 154(b) by 0 days.

(21) Appl. No.: 15/863,533

(22) Filed: Jan. 5, 2018

(65) Prior Publication Data

US 2018/0327945 A1 Nov. 15, 2018

(30) Foreign Application Priority Data

May 9, 2017 (GB) ..... 1707396.6

(51) Int. Cl.
*D04C 3/42* (2006.01)
*D04C 3/00* (2006.01)

(52) U.S. Cl.
CPC ..... *D04C 3/42* (2013.01); *D04C 3/00* (2013.01)

(58) Field of Classification Search
CPC ... D04C 3/24; D04C 3/26; D04C 3/28; D04C 3/42; D04C 3/44; D04C 7/00
See application file for complete search history.

(56) References Cited

U.S. PATENT DOCUMENTS 965,437 A * 7/1910 Brown et al. ..... D03D 37/00 139/16
1,537,445 A * 5/1925 Hodgson ..... D04C 3/38 87/18
RE20,146 E * 10/1936 McCahey ..... D02G 3/365 87/29
3,783,736 A 1/1974 Richardson
4,369,690 A 1/1983 Sapkus
(Continued)

FOREIGN PATENT DOCUMENTS

JP H02 104305 A 4/1990
WO 99/66478 A1 12/1999
WO 2004/064568 A1 8/2004

OTHER PUBLICATIONS

EP 18153388, European Search Report, dated Jun. 5, 2018, European Patent Office.

*Primary Examiner* — Shaun R Hurley
(74) *Attorney, Agent, or Firm* — Millman IP Inc.

(57) ABSTRACT

In an aspect, a braiding machine is provided, and has a set of spool shuttles that each dispense a strand of flexible material under tension. A strand retractor releasably retracts the strands from the spool shuttles. A plurality of shuttle stations at which the spool shuttles can be positioned are arranged in a circuit. At least one shuttle carriage, when driven, repeatedly selects an immediately previously unselected spool shuttle and moves the immediately previously unselected spool shuttle from an associated shuttle station to another shuttle station along the circuit spaced from the associated shuttle station by at least one shuttle station that is intermediate the associated shuttle station and the other shuttle station. At least one spool shuttle is parkable at the at least one shuttle station. A drive arrangement is coupled to the shuttle carriage to drive the shuttle carriage.

18 Claims, 18 Drawing Sheets

(56) References Cited

U.S. PATENT DOCUMENTS

| | | | | |
|---|---|---|---|---|
| 4,753,149 | A | 6/1988 | Celani | |
| 5,085,121 | A | 2/1992 | Richardson | |
| 5,988,181 | A * | 11/1999 | Gable | A45D 2/00 132/200 |
| 6,575,175 | B2 * | 6/2003 | Kim | A45D 2/00 132/210 |
| 7,069,935 | B2 * | 7/2006 | Bousfield | A45D 2/00 132/210 |
| 8,172,281 | B2 | 5/2012 | Crorey | |
| 8,534,176 | B2 * | 9/2013 | Giszter | D04C 3/42 87/55 |
| 8,746,753 | B2 | 6/2014 | Crorey | |
| 9,027,569 | B2 * | 5/2015 | Chung | A45D 7/00 132/212 |
| 9,144,284 | B2 * | 9/2015 | Chung | A45D 7/00 |
| 9,765,457 | B2 * | 9/2017 | Tahara | D04C 1/06 |
| 2003/0075198 | A1 * | 4/2003 | Kim | A45D 2/00 132/210 |
| 2009/0283107 | A1 * | 11/2009 | Noh | A45D 2/00 132/212 |
| 2011/0277618 | A1 * | 11/2011 | Giszter | D04C 3/42 87/8 |
| 2014/0197636 | A1 | 7/2014 | Crorey | |
| 2015/0275408 | A1 * | 10/2015 | Tahara | D04C 1/06 87/9 |
| 2016/0175730 | A1 | 6/2016 | Todokoro | |

* cited by examiner

BRAIDING MACHINE

CROSS-REFERENCE TO RELATED APPLICATIONS

This application claims priority to and the benefit of U.K. Patent Application No. 1707396.6 filed May 9, 2017, the contents of which are incorporated herein in their entirety.

FIELD

The specification relates generally to crafts. In particular, the following relates to braiding machines.

BACKGROUND OF THE DISCLOSURE

Braiding is the process of interlacing three or more strands of flexible material. The strands used can be textile yarns, threads, wire, hair, plastic filaments, etc. Braiding is used to make cords, ropes, twine, etc. Braiding on a non-commercial scale is done by hand and is labor intensive. Further, as the number of strands used in making a braided product increases, the complexity of the manual braiding process increases exponentially, making it prohibitively expensive from a time resource perspective.

SUMMARY OF THE DISCLOSURE

In one aspect, there is provided a braiding machine, comprising a set of strand shuttles, each of the set of the strand shuttles having a strand holder positioned for holding a strand of flexible material and for dispensing the strand of flexible material under tension, a strand retractor positioned to releasably securely receive and retract the strands from the strand shuttles, a plurality of shuttle stations at which the strand shuttles can be parked, the plurality of shuttle stations being arranged in a circuit, at least one shuttle carriage that, when driven, repeatedly selects an immediately previously unselected at least one of the set of the strand shuttles and moves the immediately previously unselected at least one of the set of the strand shuttles from an associated at least one of the plurality of the shuttle stations to another at least one of the plurality of the shuttle stations along the circuit so as to braid the strands of flexible material.

In another aspect, there is provided a braiding machine, comprising a set of strand shuttles, each of the set of the strand shuttles having a strand holder positioned for holding a strand of flexible material and for dispensing the strand of flexible material, a plurality of shuttle stations at which the strand shuttles can be parked, the plurality of shuttle stations being arranged in a circuit, at least one shuttle carriage that, when driven, repeatedly selects an immediately previously unselected at least one of the set of the strand shuttles and moves the immediately previously unselected at least one of the set of the strand shuttles from an associated at least one of the plurality of the shuttle stations to another at least one of the plurality of the shuttle stations along the circuit so as to braid the strands of flexible material, and a drive arrangement coupled to the shuttle carriage to drive the shuttle carriage.

The following paragraphs relate as appropriate to any of the aspects described above.

Optionally, the immediately previously unselected at least one of the set of the strand shuttles is an immediately previously unselected one of the set of the strand shuttles; the associated at least one of the plurality of the shuttle stations is an associated one of the plurality of the shuttle stations; and the another at least one of the plurality of the shuttle stations along the circuit is another one of the plurality of the shuttle stations along the circuit that is spaced from the associated one of the plurality of the shuttle stations by at least one of the plurality of the shuttle stations that is intermediate the associated one of the plurality of the shuttle stations and the other of the plurality of the shuttle stations.

Each of the plurality of the shuttle stations can have a support surface and a notch extending through the support surface, and each of the set of the strand shuttles can have a shuttle body with a shaft extending therefrom and defining an axis therethrough, the shaft can be sized to fit within the notches and have an enlarged feature that is spaced from the shuttle body, and the shuttle body and the enlarged feature can be sized to prevent passage thereof axially through the notches at the plurality of the shuttle stations.

The at least one shuttle carriage can be rotatably mounted on a carousel that is rotatable relative to the plurality of the shuttle stations and the drive arrangement, the carousel can be driven by the drive arrangement to rotate in a first direction, and the at least one shuttle carriage can be driven by the rotation of the carousel to rotate in a second direction opposite the first direction.

Each of the plurality of the shuttle stations can have a support surface and a notch extending through the support surface, and each of the set of the strand shuttles has a shuttle body with a shaft extending therefrom and defining an axis therethrough, the shaft being sized to fit within the notches, and the at least one shuttle carriage can have engagement features that leave the shaft of one of the set of the strand shuttles in the associated one of the plurality of the shuttle stations as the carousel is being rotated when the one of the set of the strand shuttles is at a first elevation relative to a plane of the carousel, and that engage the shaft of the one of the set of the strand shuttles and transport the one of the set of the strand shuttles out of the associated one of the plurality of the shuttle stations when the one of the set of the strand shuttles is at a second elevation relative to the rotation axis of the carousel.

The shaft of each of the set of strand shuttles can have an enlarged feature that is spaced from the shuttle body, and the engagement features can trap the enlarged features of the shafts of the strand shuttles when the one of the set of the strand shuttles is at the second elevation relative to the rotation axis of the carousel.

The carousel can have at least one lifter that elevates the immediately previously unselected one of the set of the strand shuttles from the first elevation to the second elevation when the carousel is driven by the drive arrangement.

The carousel can have a travel surface supporting the immediately previously unselected one of the set of the strand shuttles at the second elevation.

The carousel can have a shuttle guide restricting movement of the immediately previously unselected one of the set of the strand shuttles away from the at least one shuttle carriage.

The shuttle guide can have at least one loading slot that is alignable with each of the plurality of the shuttle stations for placing each of the set of the strand shuttles at a different one of the plurality of the shuttle stations.

Each of the set of the strand shuttles can have a removable spool mounted thereon with the strand wound therearound, the removable spool resisting rotation and rotating upon application of a threshold tension on the dispensed strand.

The strand retractor can have a tensioner arm that releasably securely receives and applies tension to the strands.

The tensioner arm can be hingedly coupled to the plurality of shuttle stations and biased to apply the tension to the strands dispensed by the set of the strand shuttles.

The strand retractor can include a strand guide having a passageway through which the strands pass and that is in a fixed position relative to the shuttle stations.

The tensioner arm can have a strand clamp for releasably securely receiving the strands.

The tensioner arm can have a friction grip for receiving the strands when the strand clamp is opened.

The drive arrangement can have a manual crank coupled to at least one gear that is operatively connected to rotate the carousel.

The manual crank can be restricted to rotation in a single direction via at least one pawl.

According to another aspect, there is provided a terminator for a cord, comprising a terminator plug having a sleeve with at least one strand engagement feature extending therefrom to engage a plurality of strands of flexible material, and a terminator connector having an opening dimensioned to securely receive the terminator plug therein when the terminator plug is compressed about the plurality of strands, and a retaining feature retaining the terminator plug within the opening when the terminator plug is inserted therein.

The retaining feature can comprise one of a ridge and a groove.

The terminator connector can have a mating feature for releasably engaging another terminator connector with a corresponding mating feature.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
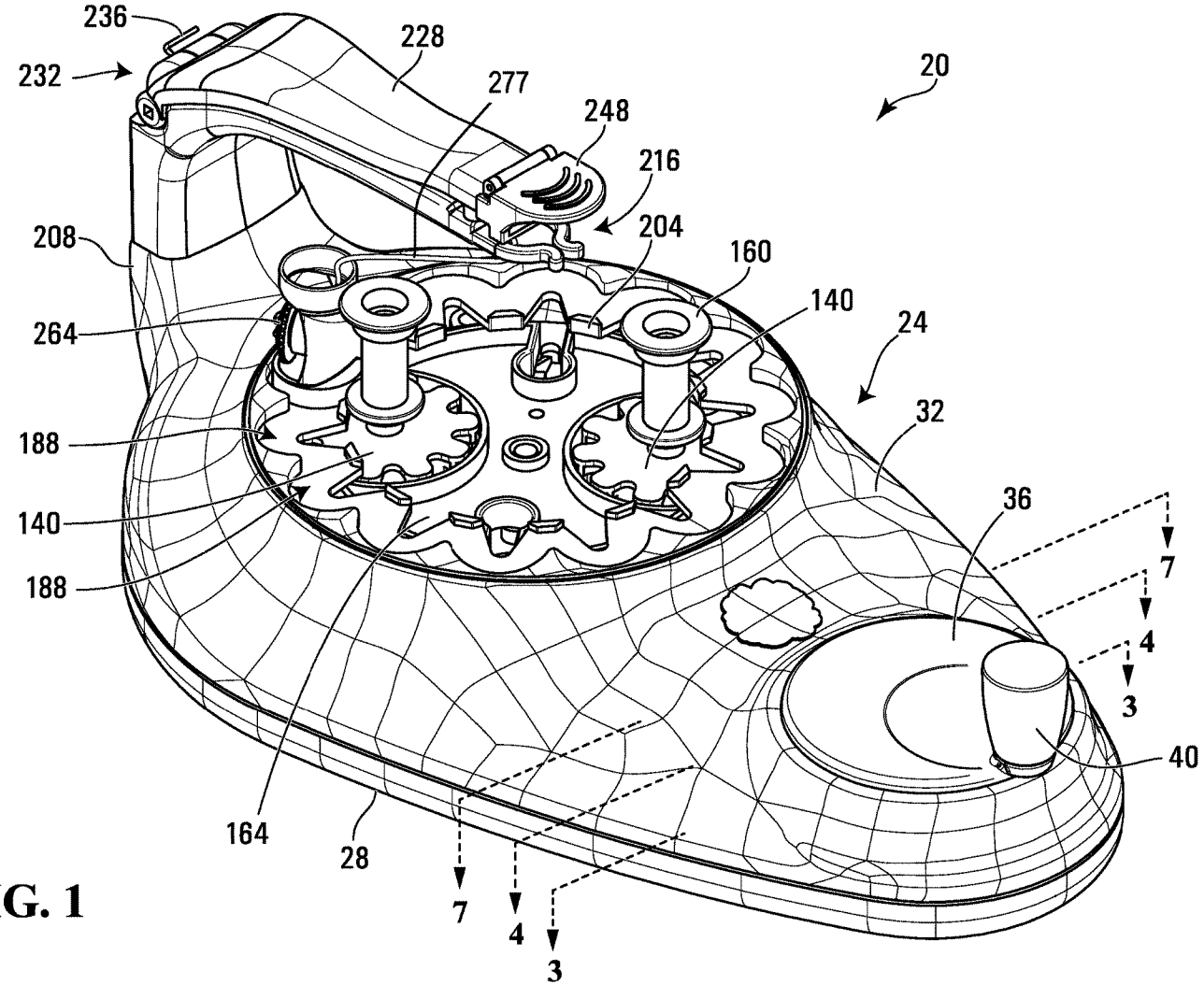
FIG. 1 is a perspective view of a braiding machine in accordance with one embodiment thereof.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Braiding machines and associated terminators are disclosed herein. The braiding machine has a set of spool shuttles that dispense a strand of flexible material under tension. The strands of flexible material can be, for example, threads, strings, wires, yarn, or hair. A strand retractor is positioned to releasably securely receive and retract the strands from the spool shuttles. A plurality of shuttle stations at which the spool shuttles can be parked are arranged in a circuit. At least one shuttle carriage coupled to the shuttle stations can be driven to repeatedly select an immediately previously unselected spool shuttle and move it from an associated shuttle station to another shuttle station along the circuit spaced from the associated shuttle station by at least one intermediate shuttle station. A drive arrangement is coupled to the shuttle carriage to drive the shuttle carriage.

Further, terminators for cords are also disclosed. The terminators have a terminator plug having a sleeve with at least one spike extending therefrom to engage a plurality of strands. A terminator connector has an opening dimensioned to securely receive the terminator plug therein when the terminator plug is compressed about the plurality of strands, and a retaining feature retaining the terminator plug within the opening when the terminator plug is inserted therein.

A braiding machine 20 in accordance with an embodiment is shown in FIG. 1. The braiding machine 20 in this embodiment makes braided cords for jewelry such as bracelets, anklets, necklaces, etc. The braiding machine 20 has a housing 24 with a base 28 and a cover 32 that enclose a number of components. A circular manual crank 36 having a crank handle 40 rotatably mounted off center thereof is rotatably positioned within an opening of the cover 32.

Referring now to FIGS. 1 to 4, the manual crank 36 forms part of a drive arrangement and is rotatably coupled to a toothed crank gear 44 rotatably mounted to the base 28 within the housing 24 of the braiding machine 20. The crank gear 44 has a toothed interior circumferential surface 48 that two spring-biased pawls 52 secured to an inside surface of the manual crank 36 engage. Rotation of the manual crank 36 in a first direction (that is, clockwise when viewed from top, as indicated by the rotation direction CW shown in FIG. 1) causes the crank gear 44 to rotate clockwise. When the manual crank 36 is rotated in a second direction opposite the first direction (that is, counter-clockwise), the pawls 52 do not engage the crank gear 44 to rotate it.

For ease of reference, rotational directions and positions may be described herein relative to a top view of the components of the braiding machine 20.

Figure 2:
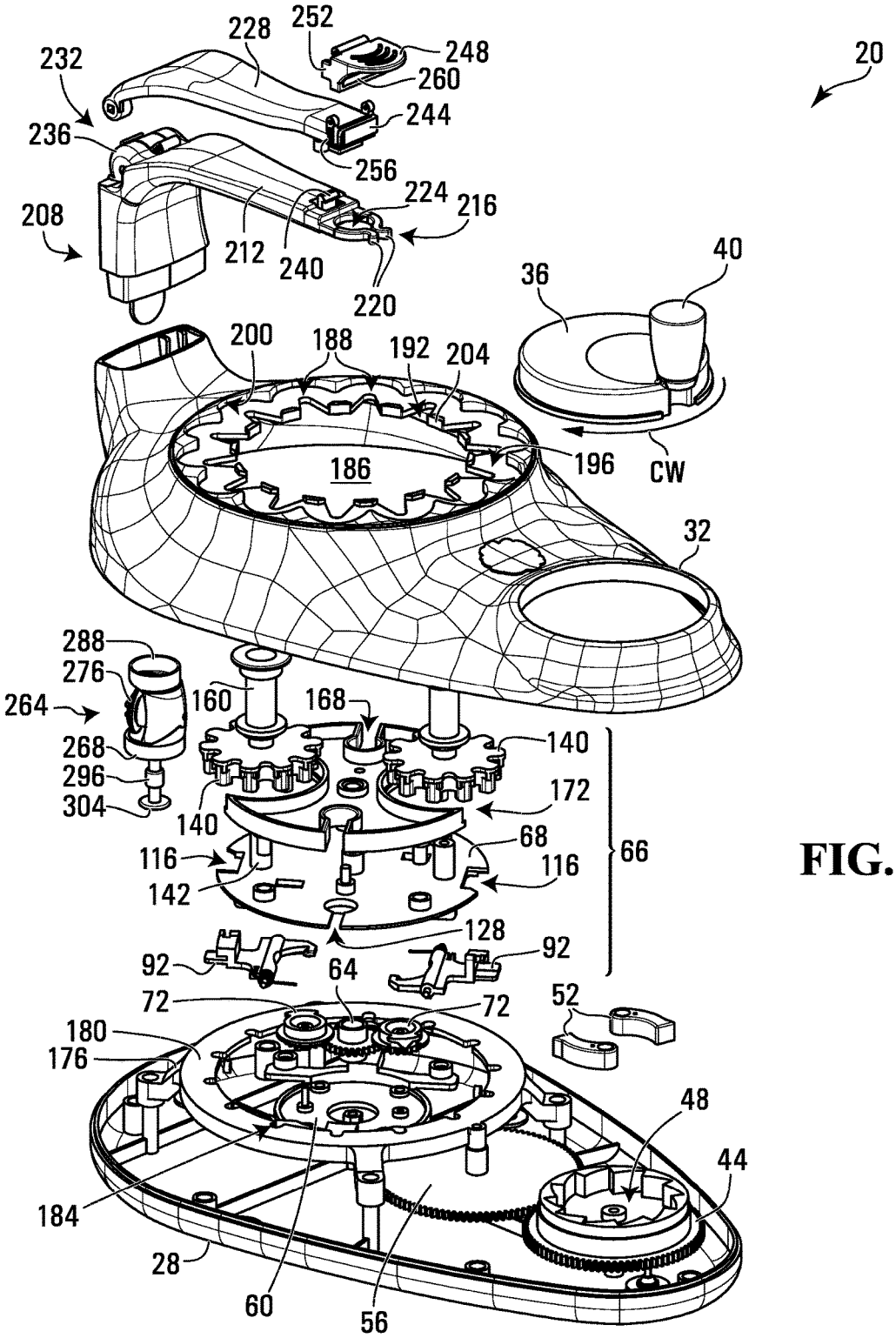
FIG. 2 is an exploded view of the braiding machine of FIG. 1.
Figure 3:
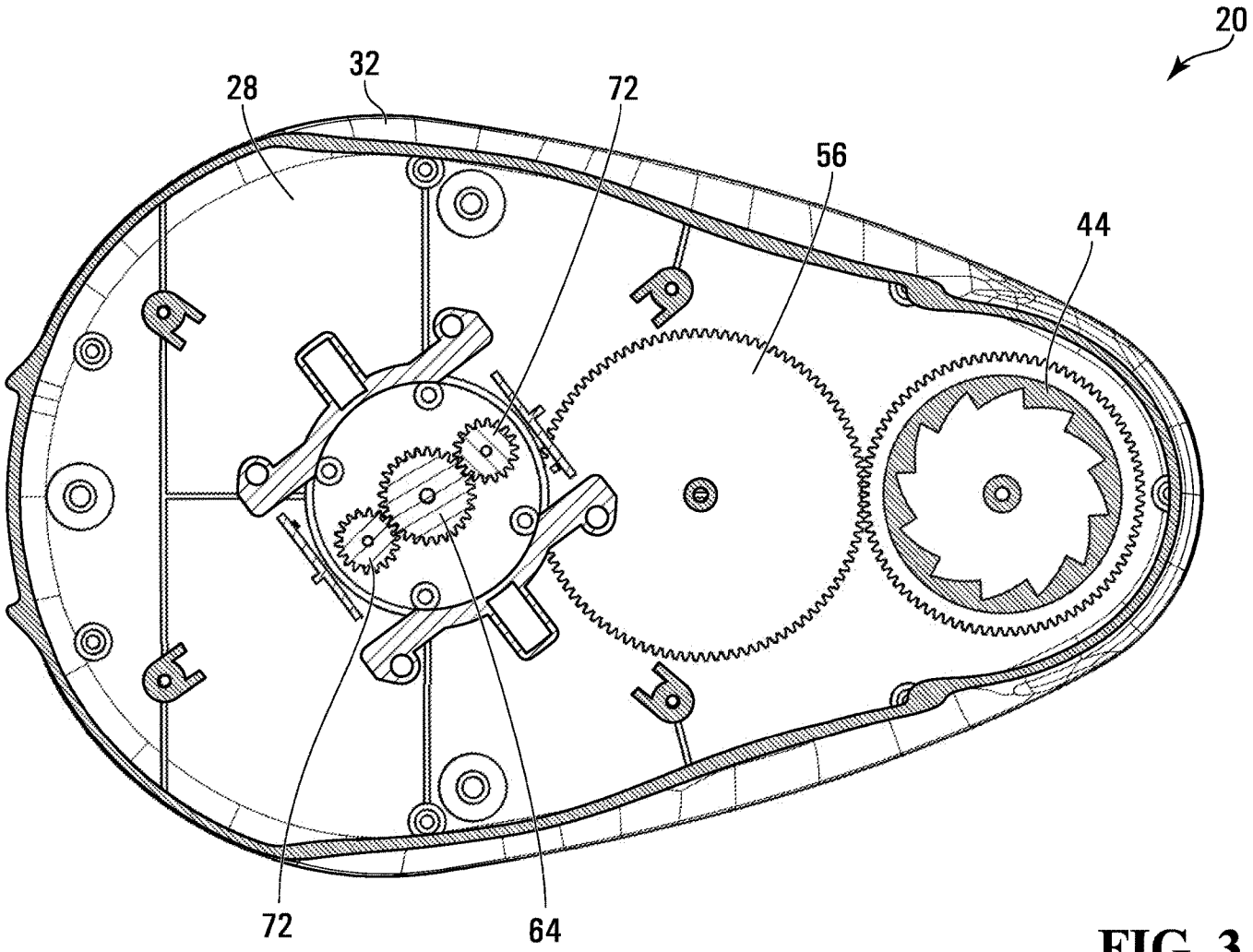
FIG. 3 is a top section view of the braiding machine of FIG. 1 along 3-3 showing a portion of a drive arrangement for driving the shuttle carousel of FIGS. 4A to 4D.

As shown in FIG. 2, the manual crank 36 forms part of a drive arrangement, with the crank gear 44, an intermediate gear 56, and a carousel gear 60. The intermediate gear 56 is rotatably mounted on the base 28 and has teeth along its periphery corresponding to and meshing with the teeth of the crank gear 44. Similarly, the carousel gear 60 is rotatably mounted to the base 28 and has teeth along its periphery corresponding to and meshing with the teeth of the intermediate gear 56. Turning of the manual crank 36 via the crank handle 40 in the clockwise direction CW causes the carousel gear 60 to also rotate in a clockwise direction. The carousel gear 60 has a central aperture enabling a fixed gear 64 to be affixed to the base 28. The fixed gear 64 does not rotate with the carousel gear 60 and remains in a fixed orientation relative to the base 28.

A carousel 66 is mounted on the carousel gear 60 and rotates with it. The carousel 66 has a carousel platform 68 that is secured to the carousel gear 60.

Now referring to FIGS. 1 to 5, two actuator gears 72 of the carousel 66 are rotatably secured between the carousel gear 60 and the carousel platform 68, and have teeth 76 that mate with teeth on the fixed gear 64. The actuator gears 72 have 18 teeth and the fixed gear 64 has 28 teeth in the current embodiment. As the carousel gear 60 rotates clockwise relative to the fixed gear 64, the actuator gears 72 are also rotated in a clockwise direction about an actuator gear rotation axis $RA_{AG}$ via meshing contact between teeth of the actuator gears 72 and the fixed gear 64. A support flange 80 extends about most of the circumference of each actuator gear 72 and is interrupted by a gap 84. Coinciding with the gap 84 about the same angular orientation about the actuator gear rotation axis $RA_{AG}$ is a depressor protrusion 88 having a sloped surface.

Two lifters 92 are pivotably secured to the underside of the carousel platform 68.

Figure 6:
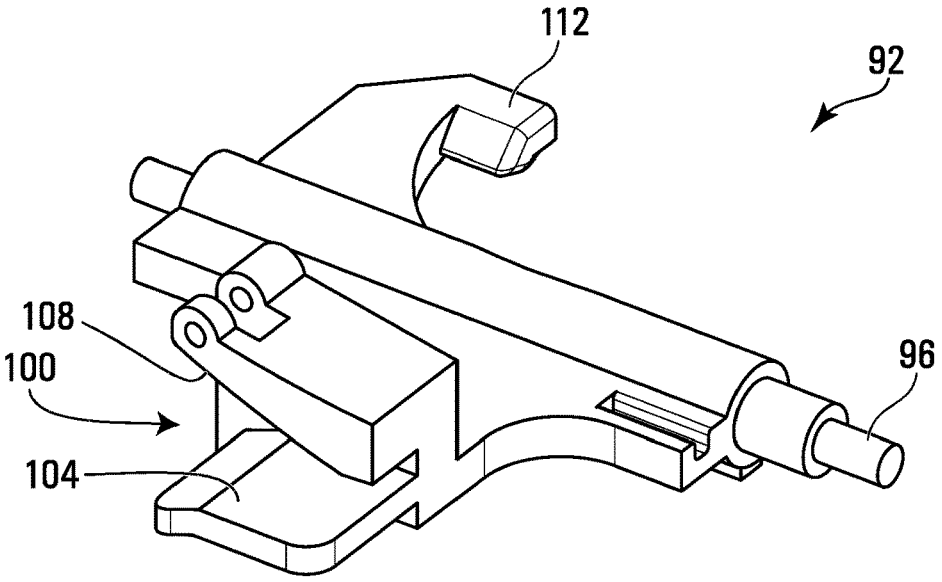
FIG. 6 is a bottom perspective view of a lifter of the braiding machine of FIG. 1 for elevating spool shuttles that is triggered by the actuator gear of FIG. 5.

FIG. 6 shows a lifter 92 in greater detail. The lifter 92 has a pivot shaft 96 extending therethrough that is fitted into brackets on the underside of the carousel platform 68. A gate 100 extends laterally from the pivot shaft 96 and has a ramp 104 and a sloped upper guide 108. The ramp 104 and the upper guide 108 form a channel. A lifter trigger 112 extends laterally on an opposite side of the pivot shaft 96. The lifters 92 are spring biased to bias the lifter triggers 112 in an upward position towards the carousel platform 68.

Figure 4:
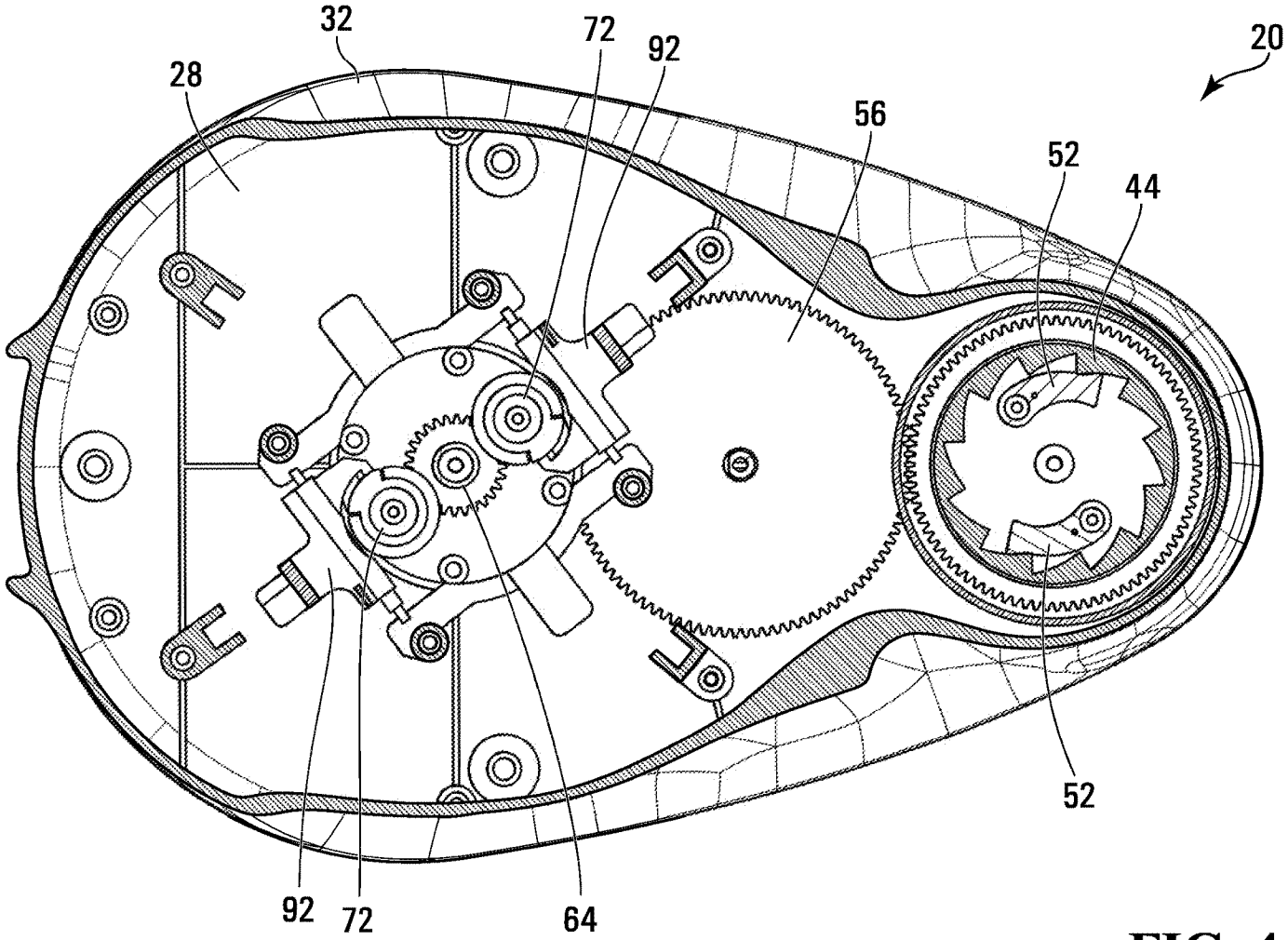
FIG. 4 is a top section view of the braiding machine of FIG. 1 along 4-4 showing the arrangement of the actuator gears and the lifters.
Figure 5:
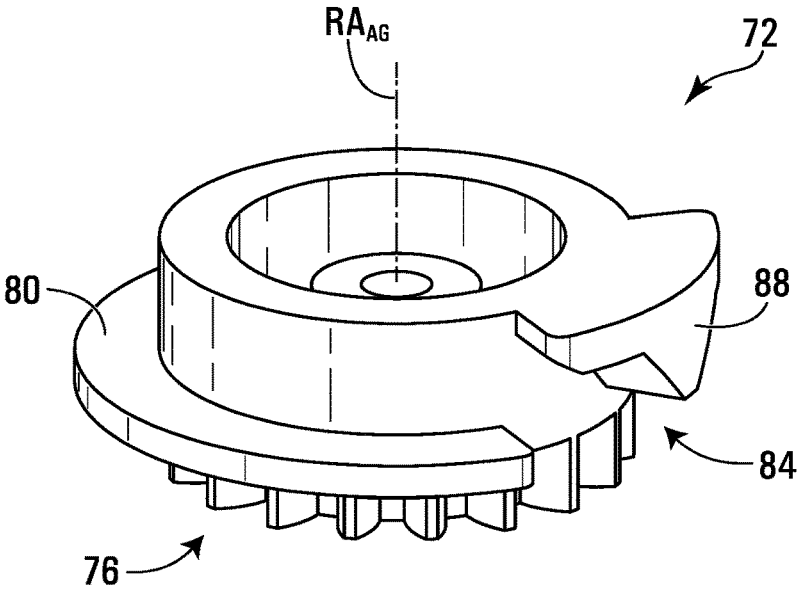
FIG. 5 is a top perspective view of an actuator gear of the braiding machine of FIG. 1.

The actuator gears 72 and the lifters 92 are positioned so that the lifter trigger 112 rests atop of the support flange 80 or below the depressor protrusion 88 as shown in FIG. 4. The lifter triggers 112 are, for most of the rotation cycle of the actuator gears 72, resting above the support flange 80. As the carousel 66 rotates, each actuator gear 72 rotates and intermittently depresses the trigger 112 of the corresponding lifter 92 via the depressor protrusion 88 as it rotates around. As there is a gap 84 in the support flange 80 of the actuator gear 72, the depressor protrusion 88 is able to overcome the force of the biasing spring of the lifter 92 and pivot the lifter trigger 112 downwards. When the lifter trigger 112 is no longer depressed by the depressor protrusion 112 after it has rotated past the lifter trigger 112, the lifter trigger 112 is allowed to pivot back up to a position above the support flange 80 until the next full rotation of the actuator gear 72. The gearing is selected in the current embodiment so that this happens once every nine shuttle stations 188 that it passes.

Figure 7:
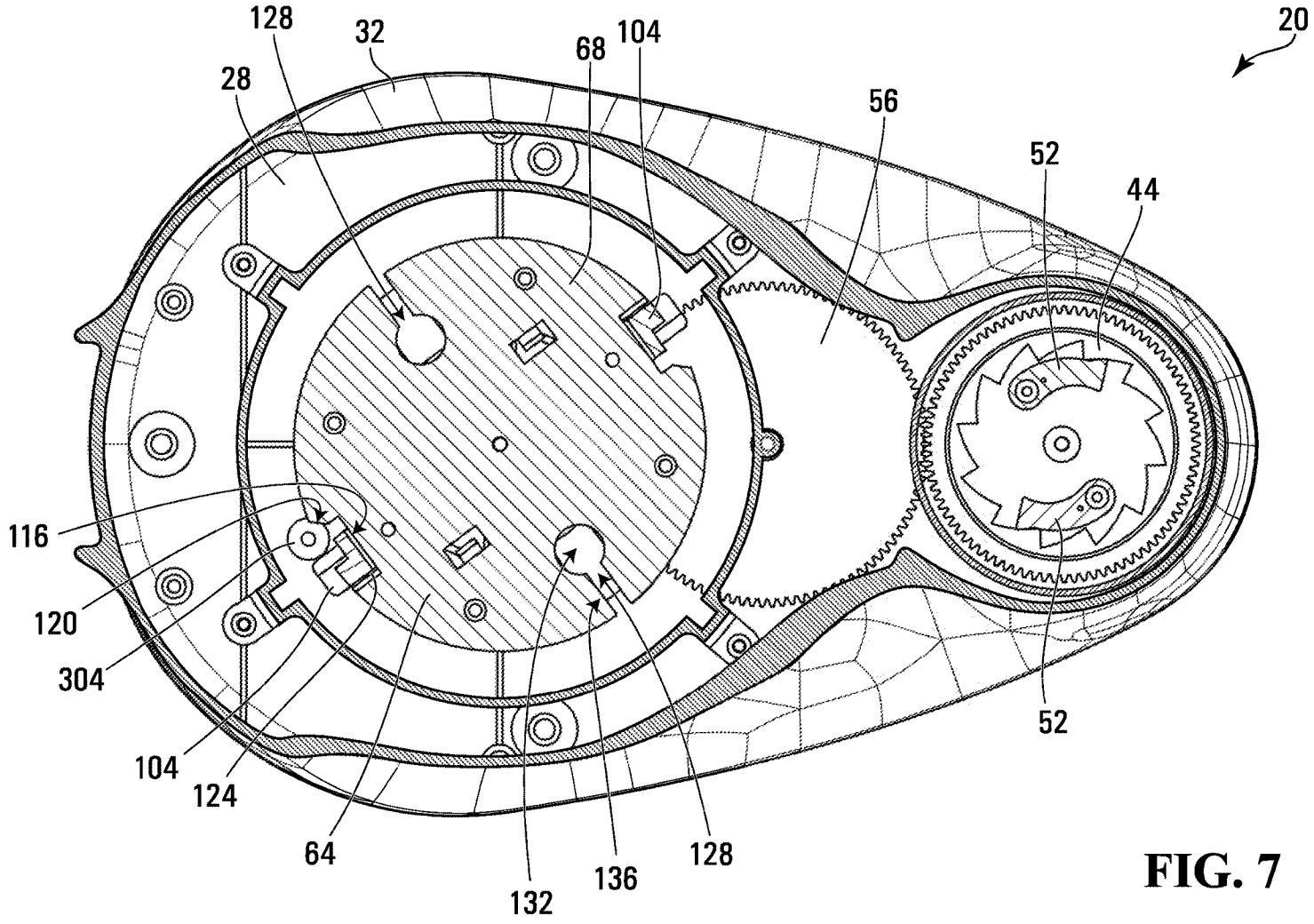
FIG. 7 is a top section view of the braiding machine of FIG. 1 along 7-7.

FIG. 7 shows the carousel platform 68 having a generally circular shape with two lift notches 116 aligned with the ramps 104 of the lifters 92. Each of the lift notches 116 has a beveled leading edge 120 and a sloped trailing edge 124. Two loading slots 128 extend into the carousel platform 68 along the circumference thereof between the lift notches 116. Each of the loading slots 128 has a round head 132 and a narrower neck 136.

Figure 8:
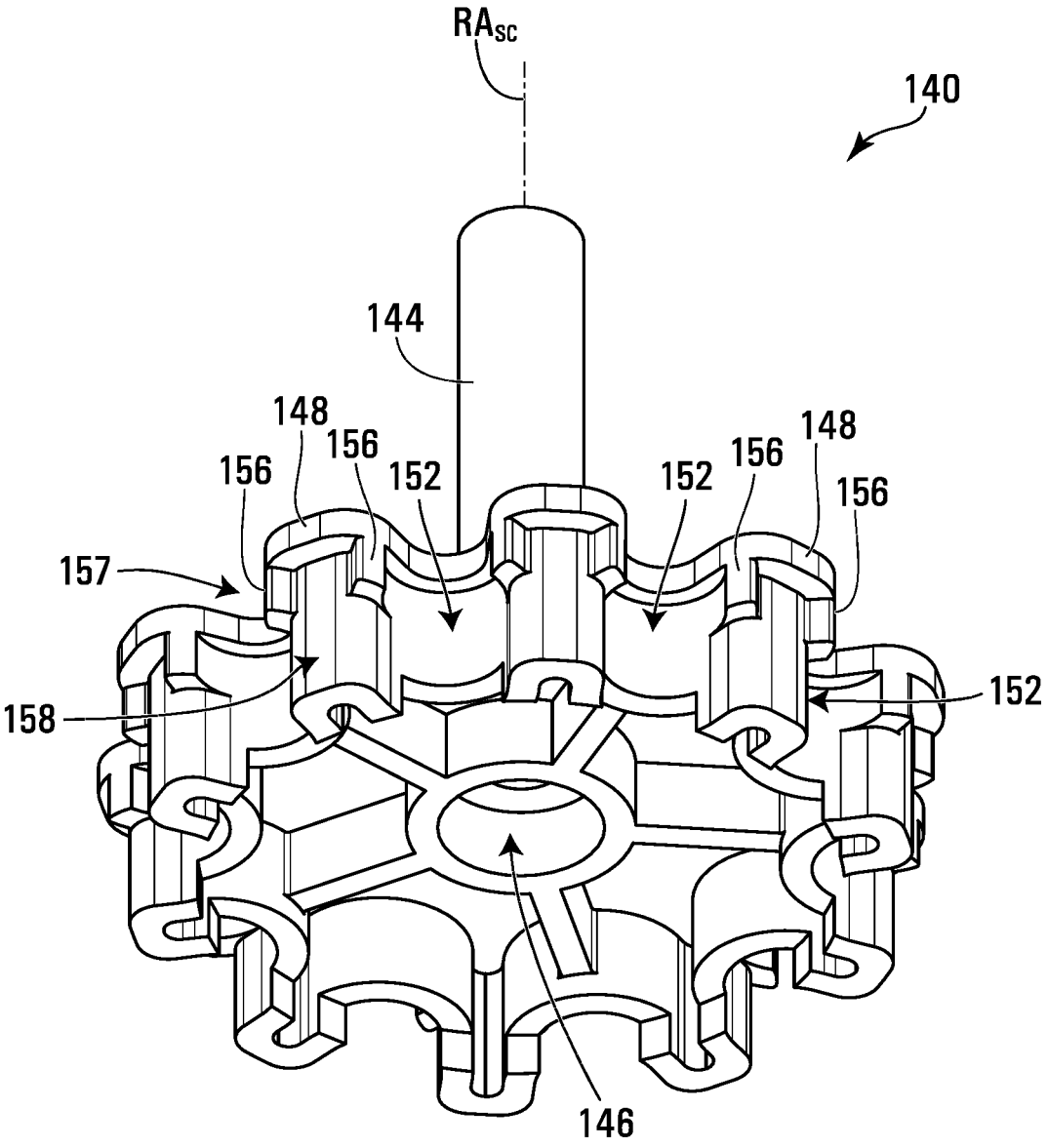
FIG. 8 is a bottom perspective view of a shuttle carriage of the braiding machine of FIG. 1 for translating spool shuttles.

Returning now to FIG. 2, two shuttle carriages 140 of the carousel 66 are shown freely rotatably mounted on posts 142 extending upwardly from the carousel platform 68. FIG. 8 shows one of the shuttle carriages 140 in greater detail. The shuttle carriage 140 has a post 144 aligned with a shuttle carriage rotation axis $RA_{SC}$ that defines a longitudinal axis of the shuttle carriage 140. An aperture 146 is dimensioned to freely rotatably receive a corresponding one of the posts 142 of the carousel platform 68. A set of ten spokes 148 radiate laterally from the post 144. The spokes 148 define recesses 152 between them. Each spoke 148 has a pair of projections 156 that extend along an engagement portion 157 of their longitudinal length, and don't extend along a bypass portion 158 that extends along another part of the longitudinal length, giving the shuttle carriage 140 different profiles perpendicular to the shuttle carriage rotation axis $RA_{SA}$. The number of spokes 148 is selected as will be explained below.

Returning again to FIG. 2, a post spacer 160 having two compressible flanges is shown positioned over the post 144 of each shuttle carriage 140. A shuttle guide 164 is secured to the carousel platform 68 and has slots 168 corresponding to the loading slots 128 of the carousel platform 68. Two generally circular gear cavities 172 are positioned along the outer region of the shuttle guide 164 between the slots 168 and are slightly larger in size than the lateral profile of the shuttle carriages 140. The shuttle guide 164 has a thickness that corresponds to that of the spokes 148 of the shuttle carriages 140.

A base shuttle support 176 is secured to posts of the base 28 and has a notched ring 180 that is supported below the shuttle guide 164 and the shuttle carriages 140. The notched ring 180 has a set of 14 notches 184 along an inside circumference thereof.

The cover 32 has a central aperture 186 aligned over the carousel 66 and about which a plurality of shuttle stations 188 (14 in total) are located. Each shuttle station 188 has a shuttle notch 192 corresponding to and aligned over one of the notches 184 in the notched ring 180 of the base shuttle support 176. The shuttle stations 188 have a generally planar support surface 196 surrounding each shuttle notch 192. An arcuate external retaining wall 200 borders each shuttle station 188 along an external lateral edge of the support surface 196. Additionally, internal retaining walls 204 bridge between the shuttle notches 192 along the internal circumference of the shuttle stations 188.

A support column 208 extends upwardly from the cover 32 and supports a guide arm 212 that extends over the central aperture 186. The guide arm 212 has a strand guide 216 at its distal end that is positioned generally centrally over the central aperture 186, and made of two curved fork members 220 that define a guide passageway 224. The fork members 220 contact one another but are flexible and can be urged apart under force.

A tensioner arm 228 is hingedly connected to the support column 208 via a tensioner arm hinge 232 and has a similar shape to that of the guide arm 212 to generally mate with it when pivoted atop of the guide arm 212. A coil spring 236 biases the tensioner arm 228 to pivot upwards away from the central aperture 186. A tensioner arm lock 240 located on a top surface of the guide arm 212 engages a corresponding feature on a bottom surface of the tensioner arm 228 to restrict the tensioner arm 228 from pivoting upwards. The tensioner arm 228 has a friction grip 244 at its distal end. The friction grip 244 has a flexible, resilient, elongated member that is positioned against the distal end of the tensioner arm 228 but can be urged away from the tensioner arm 228 under force. A strand clamp 248 is hingedly connected to the tensioner arm 228 adjacent the friction grip 244. A clamp lock 252 on a side of the strand clamp 248 engages a ridge 256 on the side of the tensioner arm 228 when the clamp lock 252 is pivoted downwards into a closed position, but can be biased away from the ridge 256 to enable the clamp lock 252 to pivot upwards to an open position. When the strand clamp 248 is pivoted upwards to an open position, the tensioner arm 228 can be releasably secured to the tensioner arm lock 240. A gate 260 on the underside of the strand clamp 248 fits under the friction grip 244 and urges the tensioner arm lock 240 to release the tensioner arm 228 when the strand clamp 248 is being locked in the closed position via the clamp lock 252.

Figure 9:
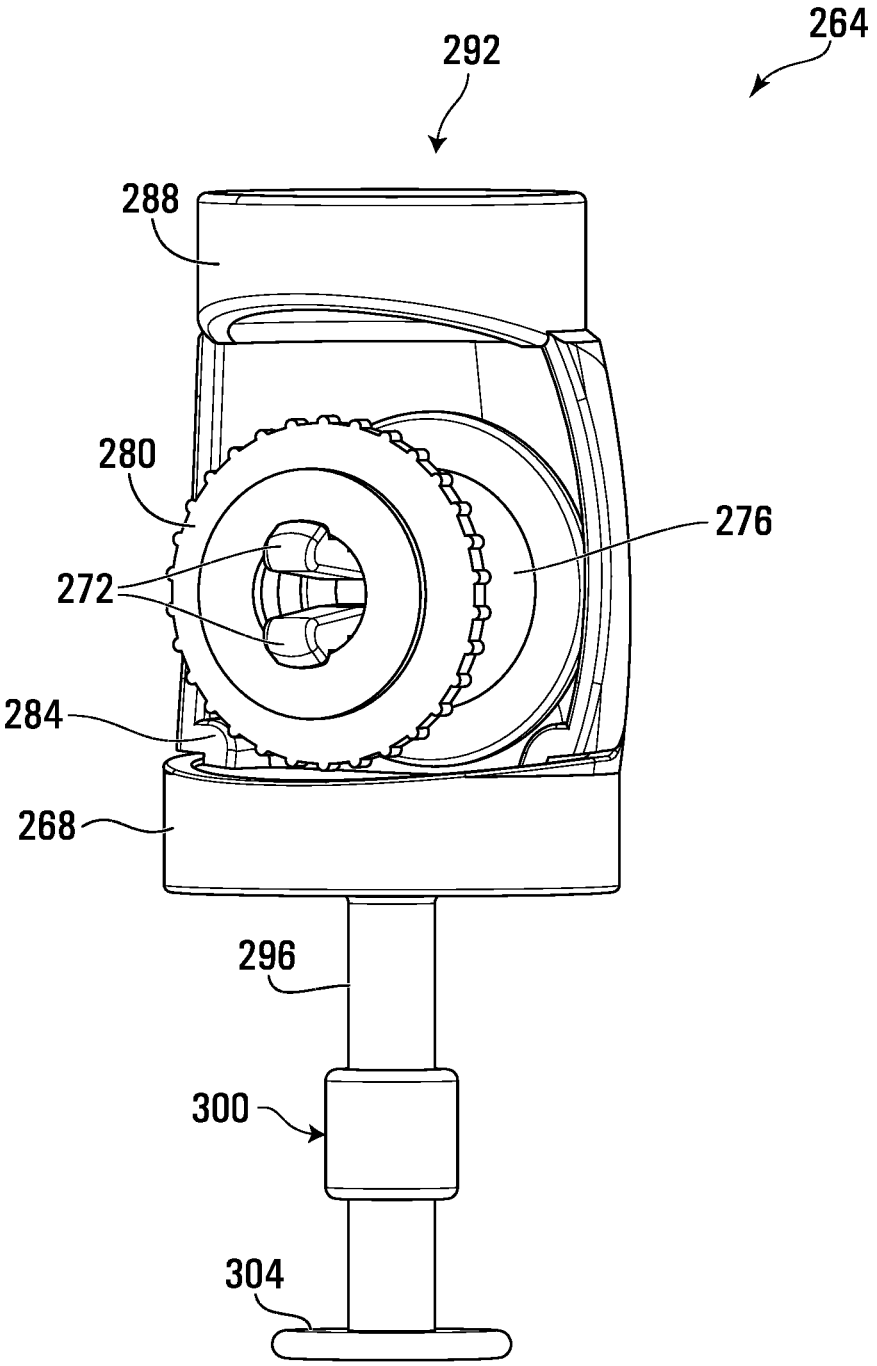
FIG. 9 is a side elevation view of a spool shuttle of the braiding machine of FIG. 1.

Now referring to FIGS. 1, 2, and 9, a spool shuttle 264 is shown. The spool shuttle 264 has a shuttle body 268 that has a pair of resilient, flexible mounting posts 272 extending from a wall thereof. The mounting posts 272 are angled away from one another and have projections with beveled edges at the distal ends thereof to retain a pre-loaded spool 276 mounted thereon. The beveled edges of the projections causes the mounting posts 272 to move to one another when the spool 276 is being mounted thereon. The spool 276 is pre-loaded with a strand of flexible material (shown at 277) prior to mounting of the spool on the mounting posts 272. After placement of the spool 276 on the mounting posts 272, the mounting posts 272 move apart and the projections restrict separation of the spool 276 from the mounting posts 272. The spool 276 has a toothed flange 280, the teeth of which impinge upon a resilient, flexible tensioning member 284. The tensioning member 284 resists passage of the teeth of the toothed flange 280 and, thus, rotation of the spool 276 on the mounting posts 272, but permits its rotation when a threshold torque is applied to the spool 276. A strand dispenser guide 288 extends above the spool 276 and has a guide aperture 292. The spool 276 can be removed from the mounting posts 272 by pinching the mounting posts 272 together so that the projections of the mounting posts 272 are aligned with the through-hole of the spool 276. A shuttle shaft 296 extends from an underside of the shuttle body 268 and is circular in lateral profile. The shuttle shaft 296 has an enlarged shaft mid-section 300 and a disc-shaped foot 304 with rounded edges at its distal end.

The working of the braiding machine will now be described with respect to FIGS. 1 to 10D.

During preparation, the strand clamp 248 of the tensioner arm 228 is opened by pivoting it upwardly. Pre-loaded spools 276 are placed on each spool shuttle 264, and the loose end of the strand wrapped therearound is inserted through the guide aperture 292 of the strand dispenser guide 288, inserted through the passageway 224 of the strand guide 216, and placed into the friction grip 244 of the tensioner arm 228. Once all of loose ends of the strands have been inserted into the friction grip 244, the strand clamp 248 is pivoted downwardly to lock it via engagement of the clamp lock 252 with the ridge 256. When the strand clamp 248 is locked, the strand ends are clamped securely in the friction grip 244. Further, the gate 260 opens the tensioner arm lock 240, thereby releasing the tensioner arm 228 and allowing the coil spring 236 to bias the tensioner arm 228 upwardly to apply tension to the strands.

Figure 10A:
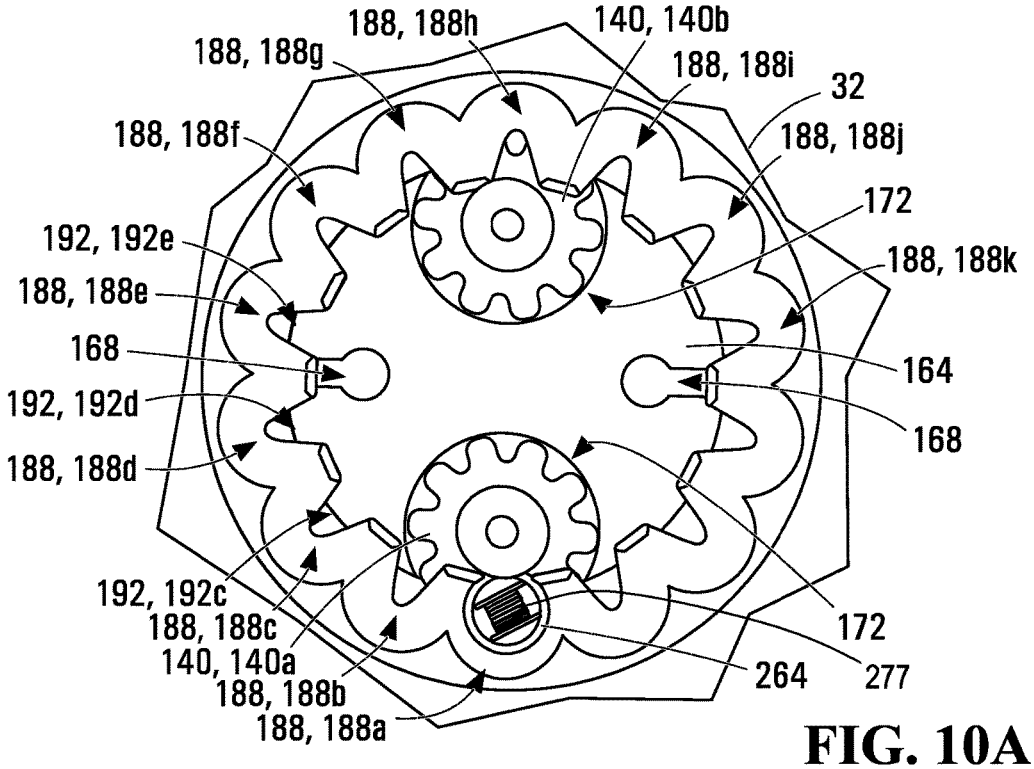
FIGS. 10A to 10D are partial plan views of a shuttle carousel of the braiding machine of FIG. 1 showing translation of a spool shuttle from a first shuttle station to another shuttle station.

FIG. 10A shows a plan view of the shuttle stations 188 and the carousel 66 after preparation, with a single spool shuttle 264 positioned at one of the shuttle stations 188*a*. For purposes of illustration, other spool shuttles are not shown, but in the described embodiment, up to twelve spool shuttles can be deployed by the braiding machine 20 simultaneously. The shuttle bodies 268 of the spool shuttles 264 rest on the cover 32 at the shuttle stations 188 with the shuttle shafts 296 being cradled by the arcuate external retaining wall 200, the internal retaining walls 204, the shuttle notches 192 and the notches 184 in the base shuttle support 176. The shuttle shafts 296 of the spool shuttles 264 are restricted within the shuttle notches 192 and the notches 184 at the shuttle stations 188 by contact with the circumferential edge of the carousel platform 68 and the shuttle guide 164.

As the carousel 66 is driven by the drive arrangement (that is, ultimately, by turning of the crank handle 40 in a clockwise direction, as indicated by arrow CW in FIG. 1), the shuttle carriages 140 are rotated with the carousel 66. While the shuttle carriages 140 freely rotate on the carousel platform 68, the spokes 148 of the shuttle carriages 140 engage and mesh with the shuttle shafts 296 that are parked at the shuttle stations 188, thereby rotating the shuttle carriages 140 in an opposite direction (i.e., counter-clockwise) relative to the rotation of the carousel 66 (i.e., clockwise). As shown, the spool shuttle 264 is at shuttle station 188*a*. The circumference and number of spokes of the shuttle carriage, and the spacing of the shuttle stations, are selected so that every second recess 152 of the shuttle carriage 140 aligns with the shuttle shaft 296 at a shuttle station 188.

For purposes of illustration, it is assumed that, in the illustrated position, the actuator gear 72 is in the correct orientation to depress the lifter trigger 112 of the lifter 92, thereby causing the gate 100 to be pivoted upwardly.

Figure 11A:
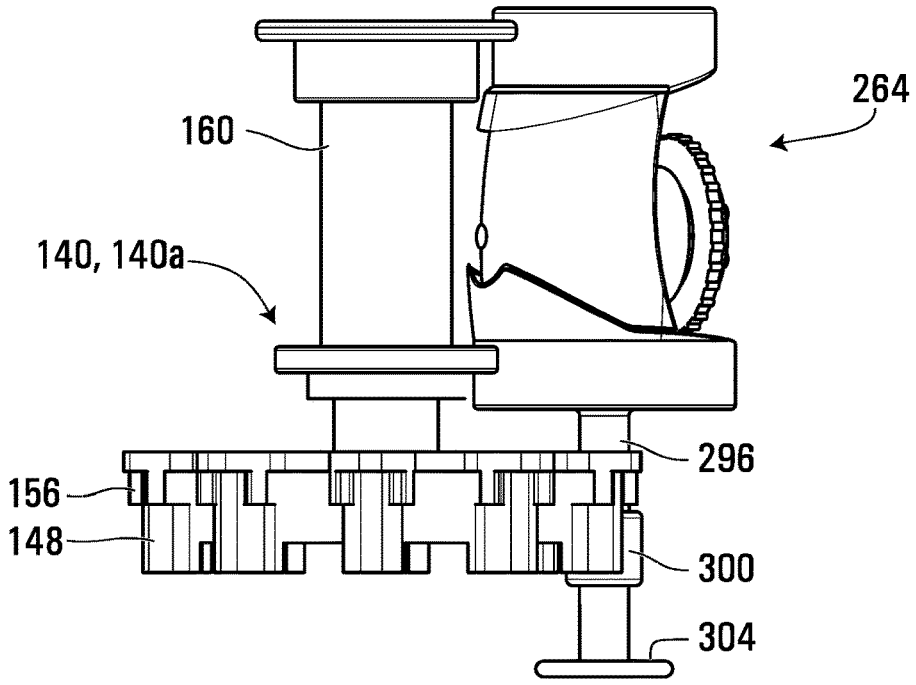
FIG. 11A is a side elevation view of the spool shuttle and the shuttle carriage of the braiding machine of FIG. 1 in isolation, wherein the spool shuttle is in the parked elevation.

FIG. 11A shows the position of the spool shuttle 264 relative to that of the adjacent shuttle carriage 140*a* before the spool shuttle 264 is elevated by the lifter 92. As can be seen, the shuttle shaft 296 is within a recess 152 of the spool carriage 140*a* and the enlarged shaft mid-section 300 is adjacent to the bypass portion 158 of the shuttle carriage 140, out of reach of the projections 156.

Figure 12A:
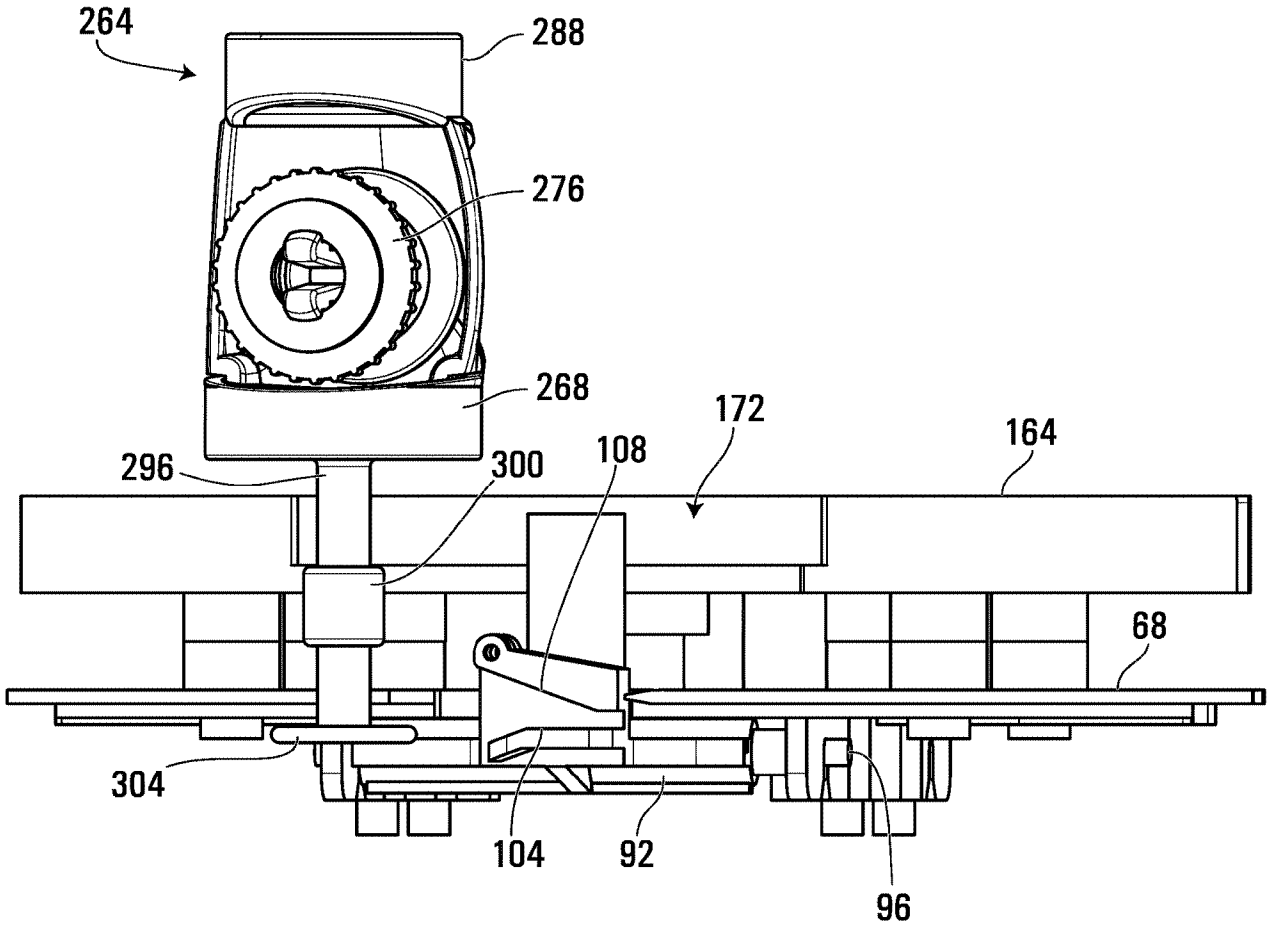
FIG. 12A is a side elevation view of a carousel platform, a shuttle guide, a lifter, and a spool shuttle of the braiding machine of FIG. 1 shown in isolation wherein the spool shuttle is positioned at a parked elevation and a foot thereof is below the carousel platform.

FIG. 12A shows the position of the lifter 92 as it approaches the spool shuttle 264 at shuttle position 188*a*. For ease of understanding, the shuttle carriage 140 has not been shown. The spool shuttle 264 is in a parked elevation, with its foot 304 positioned below the carousel platform 68. When the lifter trigger 112 of the lifter 92 is undepressed, the channel defined by the ramp 104 and the upper guide 108 of the gate 100 is aligned with the foot 304 of the spool shuttle 264.

Figure 12B:
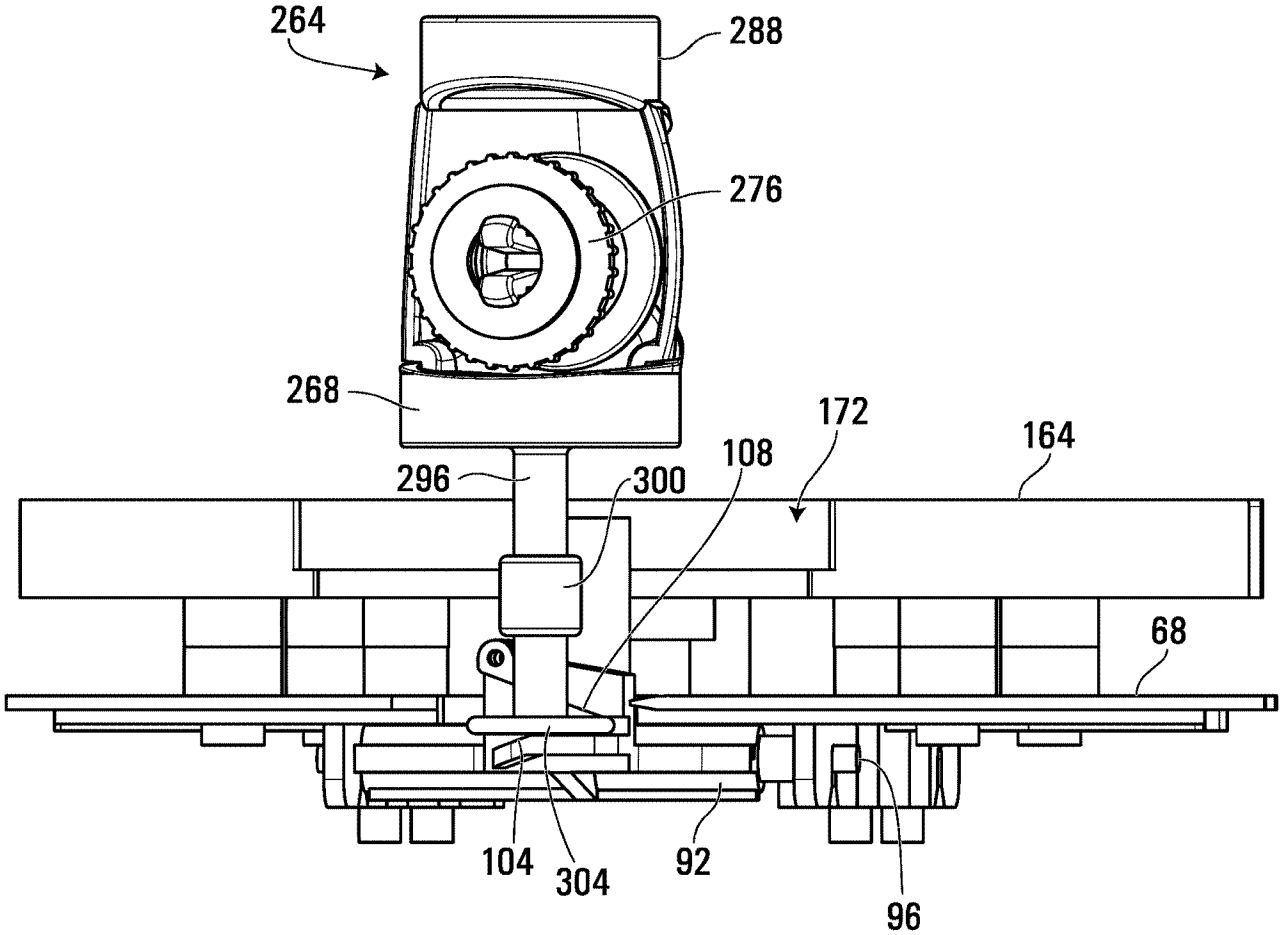
FIG. 12B is a side elevation view of the carousel platform, the shuttle guide, the lifter, and the spool shuttle of FIG. 12A shown in isolation after the spool shuttle has been elevated towards a translation elevation, wherein the foot of the spool shuttle is positioned above the carousel platform.

FIG. 12B shows the position of the lifter 92 as it is being pivoted by the actuator gear 72 at the spool shuttle 264. The ramp 104 and the upper guide 108 immediately previously guided the foot 304 into the gate 100, just before the lifter 92 is pivoted. At the illustrated point, the depressor protrusion 88 of the actuator gear 72 is rotated into contact with and depresses the lifter trigger 112, causing the gate 100 to pivot upwardly and raise the spool shuttle 264 to a mobile elevation in which the foot 304 of the spool shuttle 264 has passed through the lift notch 116 and is above the carousel platform 68. The sloped trailing edge 124 prevents catching of the spool shuttle 264 on the edge of the carousel platform 68 even when the lifter 92 and the carousel platform 68 are slightly misaligned. This is timed such that it occurs as the lifter 92 is passing a shuttle station 188.

Figure 12C:
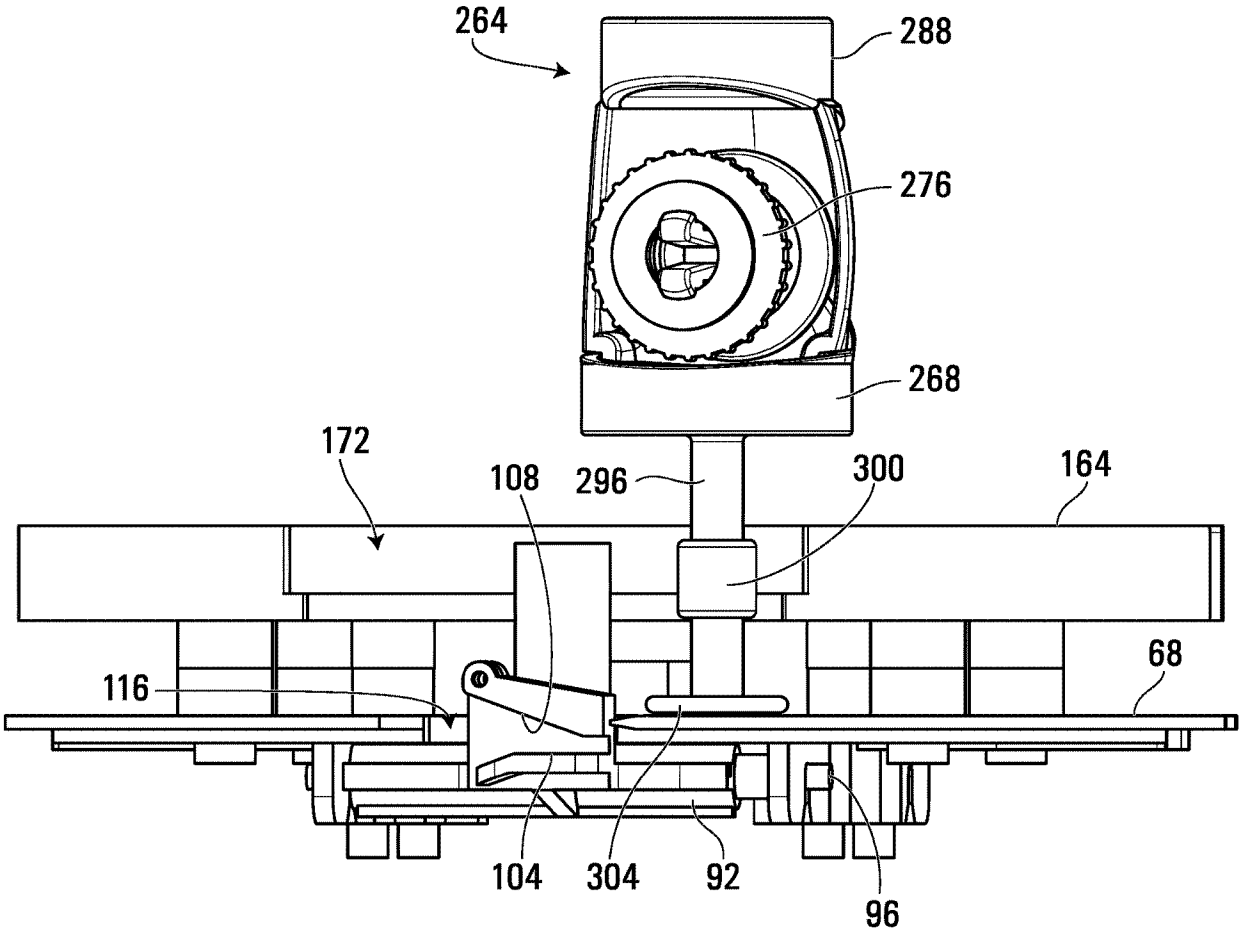
FIG. 12C is a side elevation view of the carousel platform, the shuttle guide, the lifter, and the spool shuttle of FIG. 12A shown in isolation after further translation of the shuttle carousel atop of the carousel platform.

FIG. 12C shows the position of the lifter 92 just after it is no longer being pivoted by the actuator gear 72. The gate 100 is in the process of pivoting downwards as a result of the biasing force applied by the spring on the lifter 92. As the carousel 66 is rotating clockwise (relative to a plan view), the foot 304 of the spool shuttle 264, which was previously raised to the mobile elevation in which it was above the carousel platform 68, has moved relative to the lift notch 116 of the carousel platform 68 away from the shuttle station 188*a*.

Figure 11B:
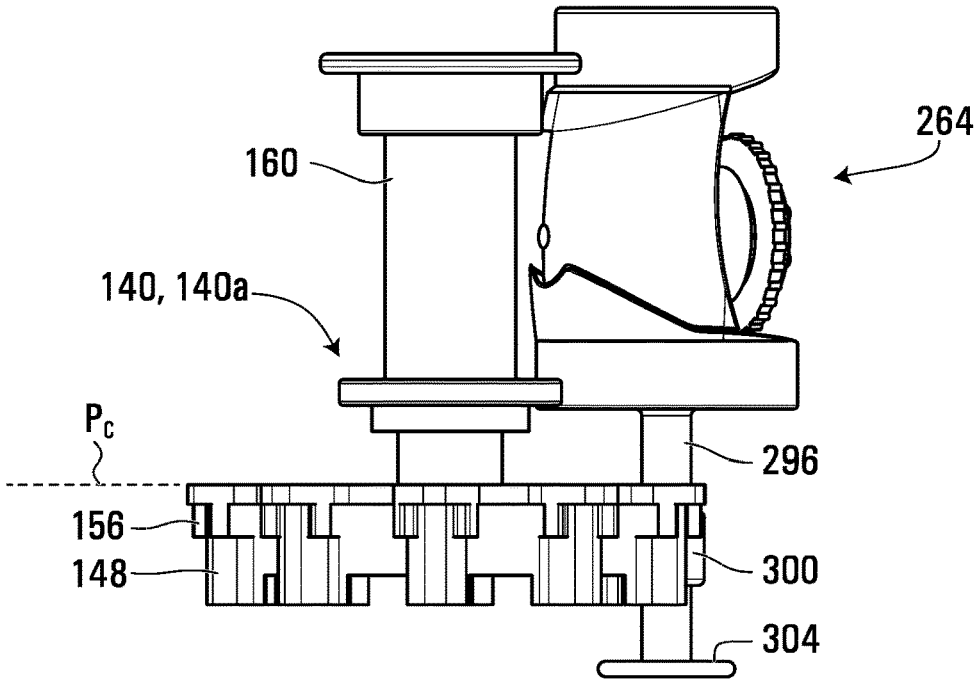
FIG. 11B is a side elevation view of the spool shuttle and the shuttle carriage of FIG. 11A, wherein the spool shuttle is in the translation elevation.

When the spool shuttle 264 is moved to the mobile elevation (that is, above the carousel platform 68) relative to a plane $P_C$ of the carousel as shown in FIG. 11B, the enlarged shaft mid-section 300 is urged into engagement by the projections 156 of the shuttle carriage 140*a* within the recess 152 to restrict lateral movement of the shuttle shaft 296. The body 268 of the spool shuttle 264 is elevated above the internal retaining walls 204 at the mobile elevation to enable the spool shuttle 264 to move away from the shuttle station 188*a*.

Figure 10B:
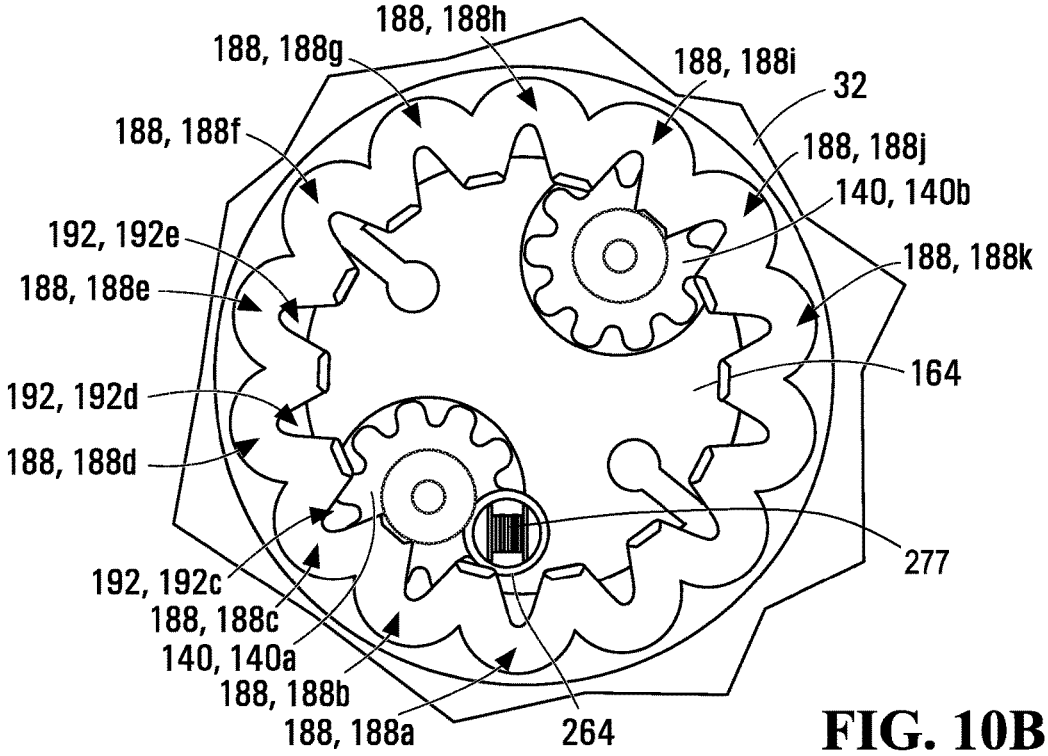

FIG. 10B shows the carousel 66 after it is rotated clockwise. After the spool shuttle 264 is elevated atop of the carousel platform 68, further rotation of the carousel 66 causes the shuttle carriages 140 to come into contact with other shuttle shafts 296 of other spool shuttles 264 parked at other shuttle stations 188 (not shown) and to be rotated counter-clockwise as a result. The surfaces of the spokes 148 of the shuttle carriages 140 in their bypass portions 158 facilitates rolling engagement and disengagement with the shuttle shafts 296. As the shuttle carriages 140 rotate, the spool shuttle 264, engaged by the projections 156 of the shuttle carriage 140*a*, is moved from the shuttle station 188*a* on an eccentric path within the gear cavities 172 of the shuttle guide 164 and is stabilized orientationally by abutment with the post spacer 160.

Figure 10C:
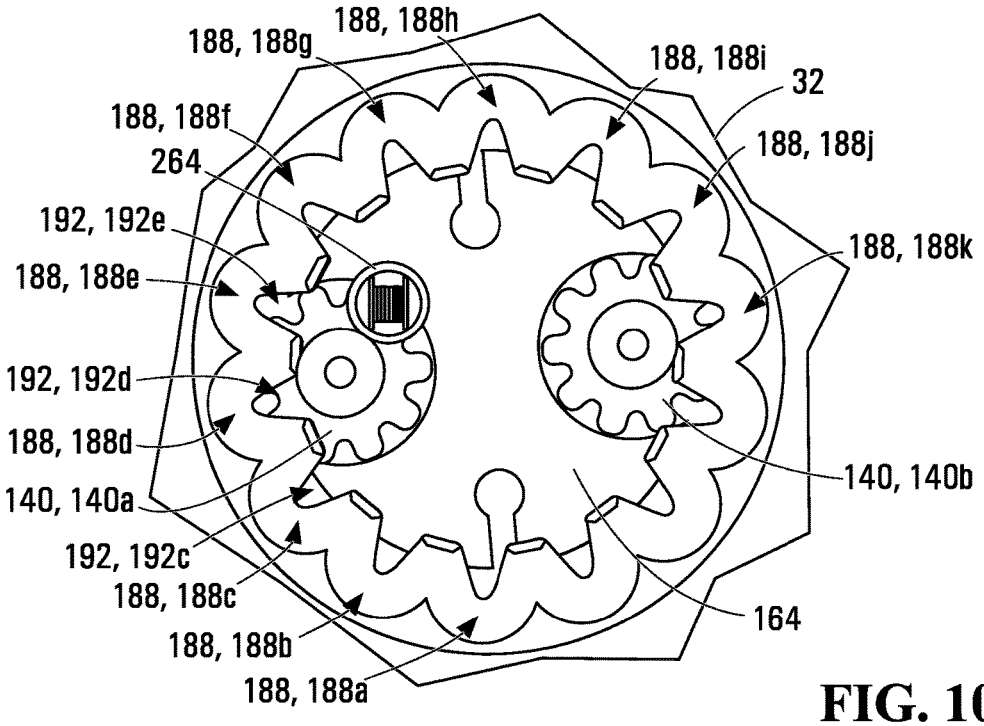

FIG. 10C shows the carousel 66 after it is rotated further clockwise, with the spool shuttle 264 elevated atop of the carousel platform 68 having been translated via counter-clockwise rotation of the shuttle carriage 140*a* relative to the carousel 66.

Figure 10D:
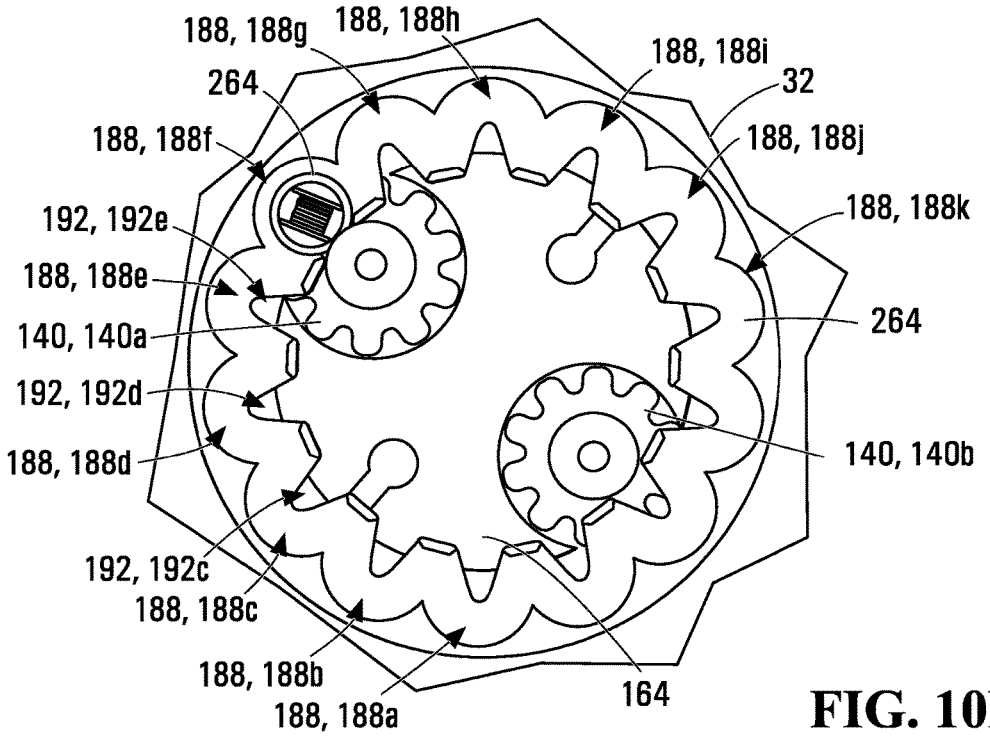

FIG. 10D shows the carousel 66 after further rotation. At this point, the spool shuttle 264 is shown positioned at shuttle station 188*f*, five shuttle stations 188 subsequent to its original shuttle station 188*a*. At this point in the rotation of the carousel 66, the depressor protrusion 88 of the corresponding actuator gear 72 is not aligned with the lifter trigger 112 of the corresponding lifter 92. As a result, the gate 100 is in the lower position depicted in FIG. 12A. As the foot 304 of the spool shuttle 264 slides off of the carousel platform 68 and into the lift notch 116, it is urged downwards by the upper guide 108 below the carousel platform 68 causing the spool shuttle 264 to return to the parked elevation. In the parked elevation, the projections 156 of the shuttle carriage 140*a* no longer engage the enlarged shaft mid-section 300, as it is located adjacent the bypass portion 158 of the spokes 156. Thus, the spool shuttle 264 remains "parked" at the shuttle station 188*f* until it is picked up again at a later time by one of the shuttle carriages 140.

As will be appreciated, one or more spool shuttles 264 will be parked at the intermediate shuttle stations 188, causing the strands dispensed by the spool shuttles 264 to be braided together to form a braided cord. Subsequent further rotation of the carousel 66 causes the shuttle carriage 140*a* to pick up an immediately previously unselected spool shuttle 264 at shuttle station 188*j*, if one is present there. Each of the shuttle carriages 140*a*, 140*b* continue this pattern of selectively moving immediately previously unselected spool shuttles while the braiding machine is operated.

As each spool shuttle 264 is moved and the strand it dispensed is braided, tension on the strand it has dispensed increases sufficiently to overcome the threshold required to cause the spool shuttles 264 to release more of the strand. The torque force applied by the coil spring 236 on the tensioner arm 264 is insufficient to cause the strands of all of the spool shuttles 264 to collectively dispense at the same time, but as strands are extended from the spool shuttles 264 as a result of their individual movements, the length of the braided cord increases, and the tensioner arm 264 pivots under the force of the coil spring 236 to keep the braided cord taut.

When it is determined that an appropriate length of cord has been made, operation of the braiding machine is stopped.

Figure 13:
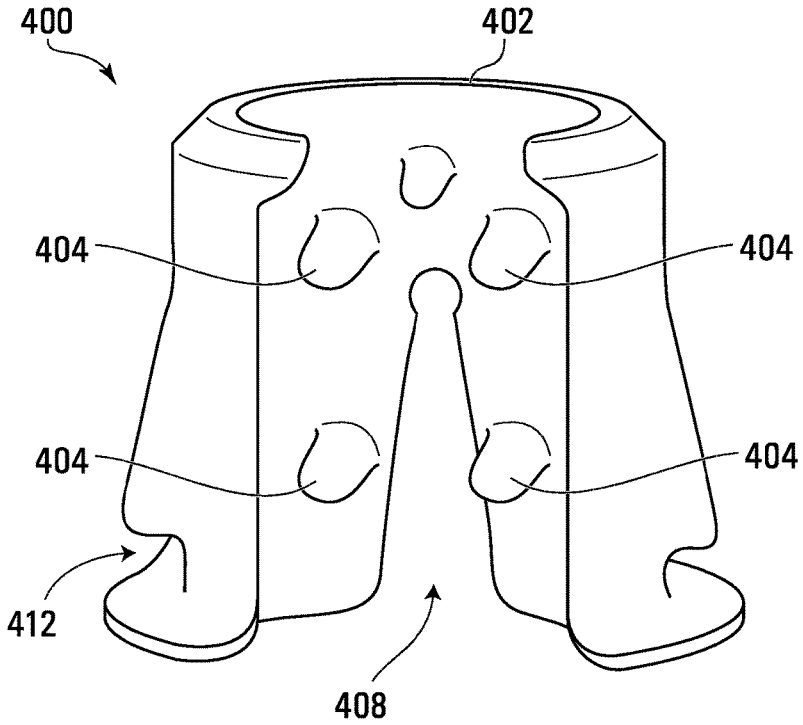
FIG. 13 shows a terminator plug used to clamp strand ends at an end of a cord made with the braiding machine of FIG. 1.

FIG. 13 shows a terminator plug 400 that is used to clamp the loose strand ends of the cord formed by the braiding machine 20. The terminator plug 400 is a sleeve 402 that has one or more spikes 404 directed inwardly. A compression notch 408 runs along a portion of the sleeve 402, and a locking groove 412 extends at least partially around the sleeve 402.

The terminator plug 400 is clamped onto the loose ends of the strands of the braided cord adjacent the strand guide 216 and pinched so that the strands can be cut without their dispersal. Then a terminator plug 400 is secured around the cord adjacent the strand clamp 248 and pinched, after which the strand clamp 248 can be opened and the excess strand length cut.

While spikes are employed to engage the strands of the braided cord by the terminator plug, other strand engagement features to engage the strands of the braided cord can be employed.

Figure 14A:
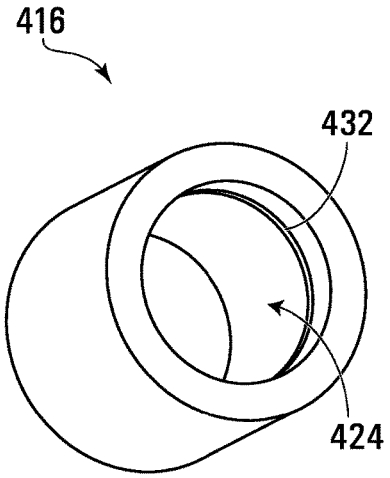
FIGS. 14A and 14B show cord terminators into which the terminator plug of FIG. 14 is inserted to retain the strands in the terminator plug.
Figure 14B:
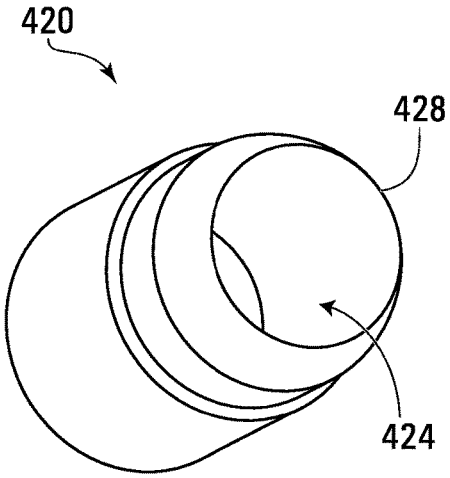

FIGS. 14A and 14B show a female cord terminator 416 and a male cord terminator 420 respectively. Both the female cord terminator 416 and the male cord terminator 420 have an opening 424 dimensioned to receive the terminator plug 400. Additionally, the openings 424 have an internal ridge (not shown) that mates with the locking groove 412 of the terminator plug 400 to lock the terminator plug 400 therein. The male cord terminator 416 has an annular projection 428 with a circumferential rib that is received within the opening 424 of the female cord terminator 416 and engages a circumferential groove 432 therein to releasably couple the male cord terminator 420 with the female cord terminator 420.

Figure 15:
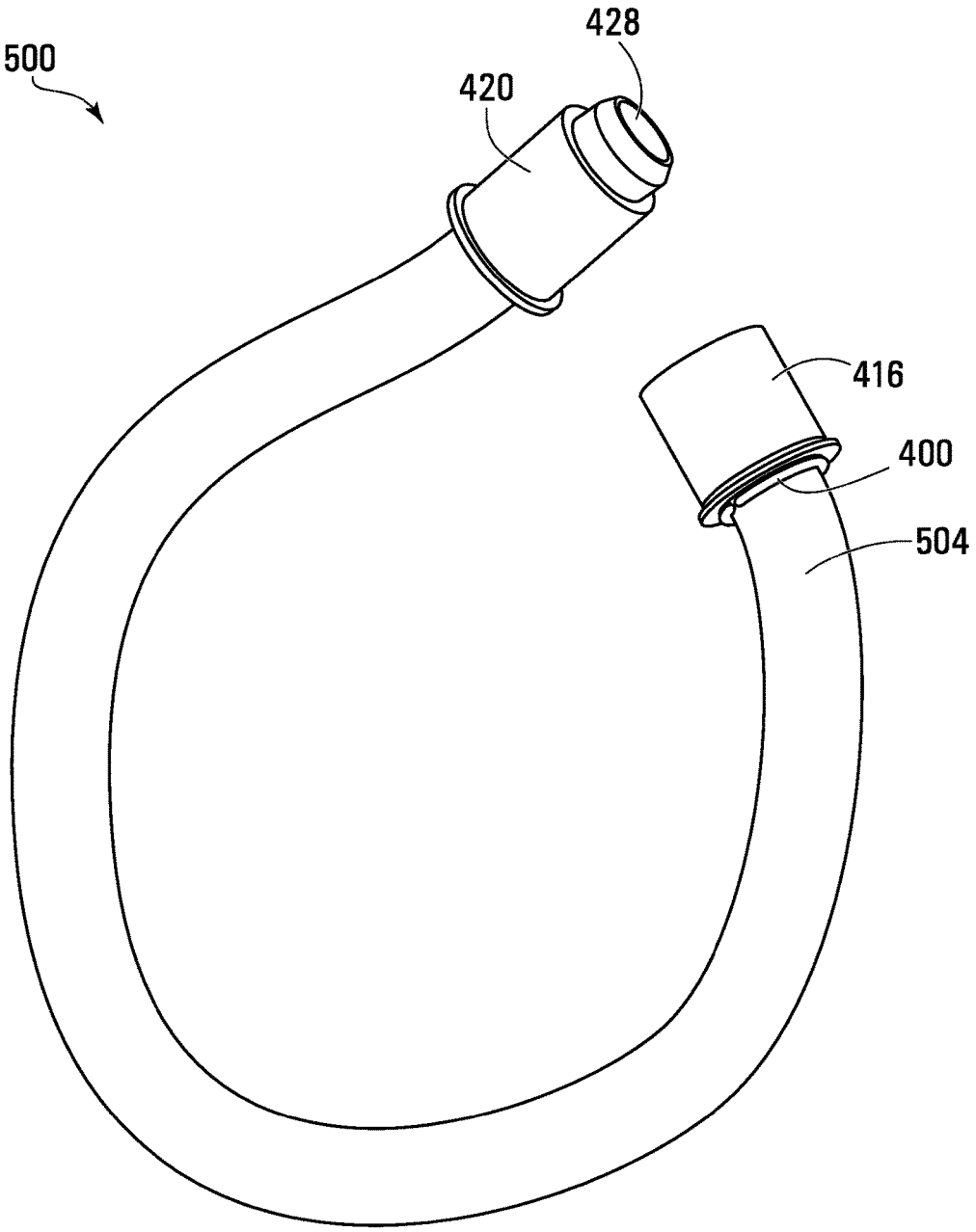
FIG. 15 shows a finished jewelry article made using the braiding machine of FIG. 1 with the terminator plugs and cord terminators of FIGS. 14 to 15B.

FIG. 15 shows a jewelry article in the form of a bracelet 500 made using the braiding machine 20 and terminated using the terminator plugs 400, the female cord terminator 416, and the male cord terminator 420. As shown, a braided cord 504 is securely coupled to the female cord terminator 416 and the male cord terminator 420 which can then be coupled together to close the bracelet 500.

While the terminator plug 400 is shown having a locking groove 412 about its outer surface that engages a ridge or other features within the openings 424 of the female cord terminator 416 and the male cord terminator 420, other corresponding engagement features can be formed on the terminator plug and the cord terminators to secure the terminator plug in the openings thereof.

Spool shuttles 264 can be deployed in the braiding machine 20 by aligning one of the loading slots 128 with an empty shuttle station 188, inserting the foot 304 of the spool shuttle 264 to be deployed into the loading slot 128 and sliding the spool shuttle 264 towards and into the empty shuttle station 188. The spool shuttles 264 can be removed from the braiding machine 20 using the reverse process.

Figure 16:
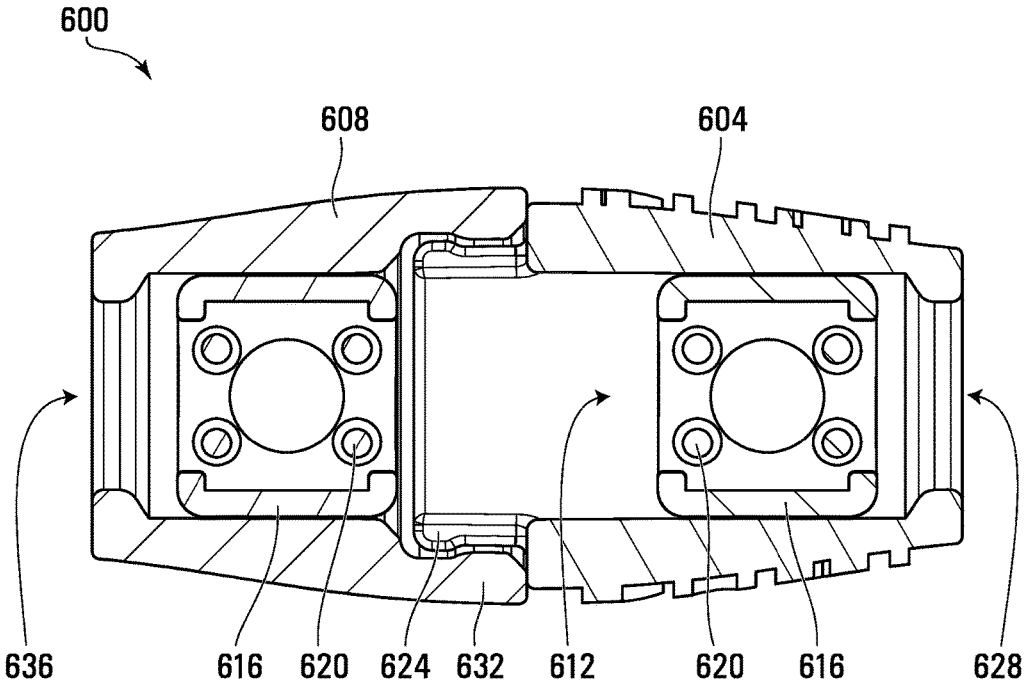
FIG. 16 is a section view of a set of mating cord terminators in accordance with another embodiment.

FIG. 16 shows a clasp 600 having a male cord terminator 604 and a female cord terminator 608 in accordance with another embodiment. The male cord terminator 604 has an internal recess 612 in which a terminator plug 616 is received. The terminator plug 616 is similar to the terminator plug 400 of FIG. 13, and has a set of spikes 620. A male connector 624 encircles the internal recess 612 and has a thick collar. A cord through-hole 628 aligns with the internal recess 612. The female cord terminator 608 similarly has an internal recess encircled by a female connector 632. The female connector 632 also has a thick collar, enabling the male cord terminator and the female cord terminator 608 to be snap-fit together but enabling their release from one another under a threshold separation tension force. A second terminator plug 616 is fit within the female cord terminator 608. A cord through-hole 636 within the female cord terminator 608 aligns with the internal recess.

In order to deploy the clasp 600, the male cord terminator 604 and the female cord terminator 608 are separated and the internal recesses 612 are cleared of terminator plugs 616, if any are present. The loose ends of a braided cord are then inserted through the cord through-hole 628, through the internal recess 612, and out through the male connector 624. The terminator plug 616 is then placed around the loose ends of the braided cord and pressed together to insert the terminator plug 616 into the internal recess 612. As the braided cord held by the terminator plug 616 is pulled back out of the male cord terminator 604, the terminator plug 616 is friction fit within the internal recess 612 and clamps the loose strands of the braided cord therein. The loose strands of the other end of the braided cord can be similarly inserted into the internal recess of the female cord terminator 608 via the cord through-hole 636. Upon pressing the terminator plug 616 onto the loose strands, the terminator plug 616 is inserted into the internal recess of the female cord terminator 608 and the braided cord is pulled back out of the female cord terminator 608 to friction fit the terminator plug 616 within the internal recess. Any loose strands extending out of the male cord terminator 604 and the female cord terminator 608 are cut. The male connector 624 of the male cord terminator 604 is inserted into the female connector 632 of the female cord terminator 608 until the thickened collars engage one another to securely hold together the male cord terminator 604 and the female cord terminator 608. When it is desired to open the clasp 600, the male cord terminator 604 and the female cord terminator 608 are pulled apart with sufficient force to enable the male connector 624 to pull out of the female connector 628 so that the male cord terminator 604 and the female cord terminator 608 can be separated.

Figure 17:
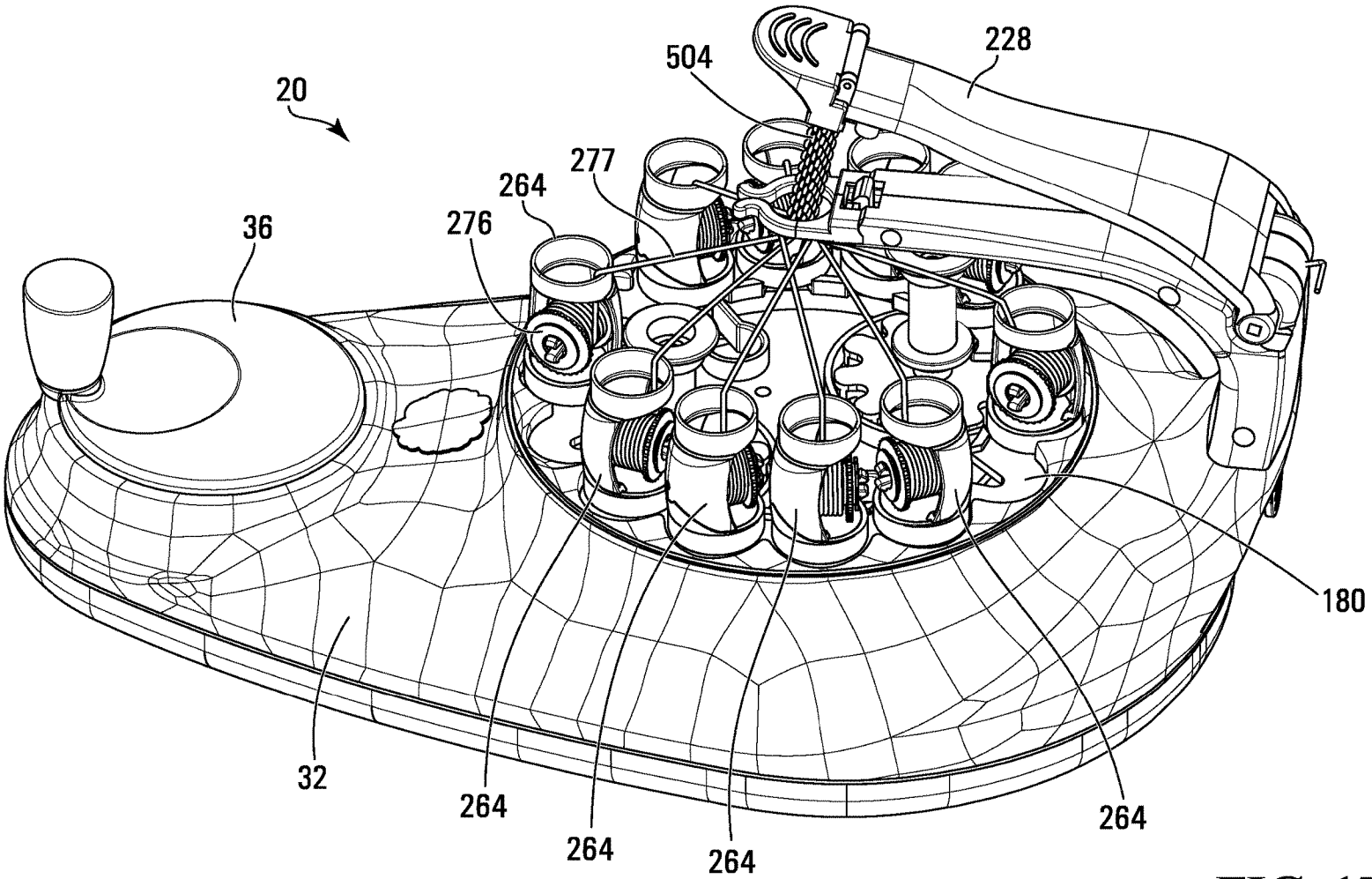
FIG. 17 is a perspective view of the braiding machine shown in FIG. 1 during operation forming a braided cord.

FIG. 17 shows the braiding machine 20 during use, braiding a plurality of strands of flexible material 277, so as to form the braided cord 504. As can be seen several strands of flexible material 277 have been crossed over one another so as to interweave them.

While the above-described braiding machine employs a tensioner arm to retract the strands, other strand retractors can be employed to retract the strands from the spools. For example, the loose ends of the strands can be secured to a clamp that is coupled to an elastic band that withdraws the clamp from the spools.

The strand guide can be any design that defines a passageway through which the strands are directed, such as a hinged loop.

Various patterns of braids can be achieved by providing pattern formulas that indicate what color or type of strand should be placed at relative shuttle stations, or even whether some shuttle stations should be left empty. The braiding machine can be used to braid cords with fewer strands by either not pulling strands from certain spool shuttles for engagement by the strand retractor, by removing spools from the spool shuttles, or by removing spool shuttles from the braiding machine.

As will be appreciated, the gearing ratios, spacing of the shuttle stations, the sizing of the shuttle carriage or carriages, etc. can all be varied.

While the braiding machine described and illustrated herein has two shuttle carriages, braiding machines can be constructed with one shuttle carriage or three or more shuttle carriages.

While the spool shuttles 264 are shown as being configured for holding spools 276, it will be appreciated by one skilled in the art that a spool shuttles 264 may be more broadly referred to as a strand shuttle 264, and that the strand shuttle be configured in any suitable way for holding the strand of flexible material 277. For example, the strand of flexible material 277 may be wound directly a flanged cylindrical shaft that is rotatable and which extends from the shuttle body 268 in place of the mounting posts 272. Such a shaft may broadly be referred to as a strand holder. Similarly, because the spool 264 is mounted to the mounting posts 272 of the spool shuttle 264, the mounting posts 272 may also together be referred to as a strand holder.

While it has been shown in the embodiment shown in the figures for the strand retractor to be biased so as to maintain tension of the strands of flexible material 277 it is alternatively possible for the braiding machine to not be provided with a strand retractor and for the machine itself not to include a means for maintaining tension in the strands of flexible material 277. In some embodiments, the user of the braiding machine may be responsible for maintaining tension in the strands of flexible material 277 during operation (e.g. by holding and pulling gently on the ends of the strands of flexible material 277. In some embodiments, the braiding activity may take place without tension being applied to the strands, thereby forming a looser braid.

For the purposes of the present disclosure, the term 'braid' is intended to be interpreted broadly to mean any cord formed by a plurality of strands which are crossed over or under one another interwoven with one another in any suitable way. The term is not intended to be limited to one specific way of interweaving the strands.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A braiding machine, comprising:

a set of strand shuttles, each of the set of the strand shuttles having a strand holder positioned for holding a strand of flexible material and for dispensing the strand of flexible material under tension;

a strand retractor positioned to releasably securely receive and retract the strands from the strand shuttles;

a plurality of shuttle stations at which the strand shuttles can be parked, the plurality of shuttle stations being arranged in a circuit;

a carousel that is rotatable relative to the plurality of the shuttle stations;

a drive arrangement coupled to the carousel to drive the carousel to rotate in a first direction; and at least one shuttle carriage rotatably mounted on the carousel and being driven by the rotation of the carousel in the first direction to rotate in a second direction opposite the first direction, the at least one shuttle carriage, when driven, repeatedly selecting an immediately previously unselected at least one of the set of the strand shuttles and moving the immediately previously unselected at least one of the set of the strand shuttles from an associated at least one of the plurality of the shuttle stations to another at least one of the plurality of the shuttle stations along the circuit so as to braid the strands of flexible material.

2. A braiding machine as claimed in claim 1, wherein the immediately previously unselected at least one of the set of the strand shuttles is an immediately previously unselected one of the set of the strand shuttles, wherein said associated at least one of the plurality of the shuttle stations is an associated one of the plurality of the shuttle stations, and wherein said another at least one of the plurality of the shuttle stations along the circuit is another one of the plurality of the shuttle stations along the circuit that is spaced from the associated one of the plurality of the shuttle stations by at least one of the plurality of the shuttle stations that is intermediate the associated one of the plurality of the shuttle stations and the other of the plurality of the shuttle stations.

3. A braiding machine as claimed in claim 1, wherein each of the plurality of the shuttle stations has a support surface and a notch extending through the support surface, and each of the set of the strand shuttles has a shuttle body with a shaft extending therefrom and defining an axis therethrough, the shaft being sized to fit within the notches and having an enlarged feature that is spaced from the shuttle body, the shuttle body and the enlarged feature being sized to prevent passage thereof axially through the notches at the plurality of the shuttle stations.

4. A braiding machine as claimed in claim 1, wherein each of the plurality of the shuttle stations has a support surface and a notch extending through the support surface, and each of the set of the strand shuttles has a shuttle body with a shaft extending therefrom and defining an axis therethrough, the shaft being sized to fit within the notches, and wherein the at least one shuttle carriage has engagement features that leave the shaft of at least one of the set of the strand shuttles in the associated at least one of the plurality of the shuttle stations as the carousel is being rotated when the at least one of the set of the strand shuttles is at a first elevation relative to a plane of the carousel, and that engage the shaft of the at least one of the set of the strand shuttles and transport the at least one of the set of the strand shuttles out of the associated at least one of the plurality of the shuttle stations when the at least one of the set of the strand shuttles is at a second elevation relative to the rotation axis of the carousel.

5. A braiding machine as claimed in claim 4, wherein the shaft of each of the set of strand shuttles has an enlarged feature that is spaced from the shuttle body, and wherein the engagement features trap the enlarged features of the shafts of the strand shuttles when the one of the set of the strand shuttles is at the second elevation relative to the rotation axis of the carousel.

6. A braiding machine as claimed in claim 4, wherein the carousel has at least one lifter that elevates the immediately previously unselected at least one of the set of the strand shuttles from the first elevation to the second elevation when the carousel is driven by the drive arrangement.

7. A braiding machine as claimed in claim 6, wherein the carousel has a travel surface supporting the immediately previously unselected at least one of the set of the strand shuttles at the second elevation.

8. A braiding machine as claimed in claim 7, wherein the carousel has a shuttle guide restricting movement of the immediately previously unselected at least one of the set of the strand shuttles away from the at least one shuttle carriage.

9. A braiding machine as claimed in claim 8, wherein the shuttle guide has at least one loading slot that is alignable with each of the plurality of the shuttle stations for placing each of the set of the strand shuttles at a different one of the plurality of the shuttle stations.

10. A braiding machine as claimed in claim 1, wherein each of the set of the strand shuttles has a removable spool mounted thereon with the strand wound therearound, the removable spool resisting rotation and rotating upon application of a threshold tension on the dispensed strand.

11. A braiding machine as claimed in claim 1, wherein the drive arrangement has a manual crank coupled to at least one gear that is operatively connected to rotate the carousel.

12. A braiding machine as claimed in claim 11, wherein the manual crank is restricted to rotation in a single direction via at least one pawl.

13. A braiding machine, comprising:

a set of strand shuttles, each of the set of the strand shuttles having a strand holder positioned for holding a strand of flexible material and for dispensing the strand of flexible material;

a plurality of shuttle stations at which the strand shuttles can be parked, the plurality of shuttle stations being arranged in a circuit;

a carousel that is rotatable relative to the plurality of the shuttle stations;

a drive arrangement coupled to the carousel to drive the carousel to rotate in a first direction; and at least one shuttle carriage rotatably mounted on the carousel and being driven by the rotation of the carousel in the first direction to rotate in a second direction opposite the first direction, the at least one shuttle carriage, when driven, repeatedly selecting an immediately previously unselected at least one of the set of the strand shuttles and moving the immediately previously unselected at least one of the set of the strand shuttles from an associated at least one of the plurality of the shuttle stations to another at least one of the plurality of the shuttle stations along the circuit so as to braid the strands of flexible material.

14. A braiding machine as claimed in claim 13, wherein the immediately previously unselected at least one of the set of the strand shuttles is an immediately previously unselected one of the set of the strand shuttles, wherein said associated at least one of the plurality of the shuttle stations is an associated one of the plurality of the shuttle stations, and wherein said another at least one of the plurality of the shuttle stations along the circuit is another one of the plurality of the shuttle stations along the circuit that is spaced from the associated one of the plurality of the shuttle stations by at least one of the plurality of the shuttle stations that is intermediate the associated one of the plurality of the shuttle stations and the other of the plurality of the shuttle stations.

15. A braiding machine as claimed in claim 13, wherein each of the plurality of the shuttle stations has a support surface and a notch extending through the support surface, and each of the set of the strand shuttles has a shuttle body with a shaft extending therefrom and defining an axis therethrough, the shaft being sized to fit within the notches and having an enlarged feature that is spaced from the shuttle body, the shuttle body and the enlarged feature being sized to prevent passage thereof axially through the notches at the plurality of the shuttle stations.

16. A braiding machine as claimed in claim 13, wherein each of the plurality of the shuttle stations has a support surface and a notch extending through the support surface, and each of the set of the strand shuttles has a shuttle body with a shaft extending therefrom and defining an axis therethrough, the shaft being sized to fit within the notches, and wherein the at least one shuttle carriage has engagement features that leave the shaft of at least one of the set of the strand shuttles in the associated at least one of the plurality of the shuttle stations as the carousel is being rotated when the at least one of the set of the strand shuttles is at a first elevation relative to a plane of the carousel, and that engage the shaft of the at least one of the set of the strand shuttles and transport the at least one of the set of the strand shuttles out of the associated at least one of the plurality of the shuttle stations when the at least one of the set of the strand shuttles is at a second elevation relative to the rotation axis of the carousel.

17. A braiding machine as claimed in claim 16, wherein the shaft of each of the set of strand shuttles has an enlarged feature that is spaced from the shuttle body, and wherein the engagement features trap the enlarged features of the shafts of the strand shuttles when the one of the set of the strand shuttles is at the second elevation relative to the rotation axis of the carousel.

18. A braiding machine as claimed in claim 16, wherein the carousel has at least one lifter that elevates the immediately previously unselected at least one of the set of the strand shuttles from the first elevation to the second elevation when the carousel is driven by the drive arrangement.

* * * * *